US011284645B2

(12) United States Patent
Wang et al.

(10) Patent No.: US 11,284,645 B2
(45) Date of Patent: Mar. 29, 2022

(54) VAPORIZATION DEVICE

(71) Applicant: SHENZHEN RELX TECHNOLOGY CO., LTD., Shenzhen (CN)

(72) Inventors: Hui Wang, Shenzhen (CN); Shengyang Xu, Shenzhen (CN)

(73) Assignee: SHENZHEN RELX TECHNOLOGY CO., LTD., Shenzhen (CN)

( * ) Notice: Subject to any disclaimer, the term of this patent is extended or adjusted under 35 U.S.C. 154(b) by 108 days.

(21) Appl. No.: 16/807,113

(22) Filed: Mar. 2, 2020

(65) Prior Publication Data

US 2021/0106059 A1 Apr. 15, 2021

(30) Foreign Application Priority Data

Oct. 10, 2019 (CN) ..... 201910958493.2

(51) Int. Cl.
*A24F 40/48* (2020.01)
*A24F 40/46* (2020.01)

(52) U.S. Cl.
CPC ..... *A24F 40/48* (2020.01); *A24F 40/46* (2020.01)

(58) Field of Classification Search
CPC ..... A24F 40/10; A24F 40/40; A24F 40/46; A24F 40/48; A24F 40/485
USPC ..... 131/328, 329
See application file for complete search history.

(56) References Cited

U.S. PATENT DOCUMENTS

| | | | | |
|---|---|---|---|---|
| 2018/0153219 | A1 | 6/2018 | Verleur et al. | |
| 2020/0068951 | A1* | 3/2020 | Li | H05B 3/46 |
| 2021/0084975 | A1* | 3/2021 | Xu | A24F 40/10 |
| 2021/0084976 | A1* | 3/2021 | Xu | A24F 40/46 |
| 2021/0106061 | A1* | 4/2021 | Wang | A24F 40/485 |

FOREIGN PATENT DOCUMENTS

| | | | |
|---|---|---|---|
| CN | 108185536 | A | 6/2018 |
| CN | 108354235 | A | 8/2018 |
| CN | 108576938 | A | 9/2018 |
| CN | 208624651 | U | 3/2019 |
| CN | 209403574 | U | 9/2019 |

OTHER PUBLICATIONS

International Search Report and Written Opinion of corresponding PCT Patent Application No. PCT/CN2019/110323 dated Jun. 29, 2020.

* cited by examiner

*Primary Examiner* — Hae Moon Hyeon
(74) *Attorney, Agent, or Firm* — Idea Intellectual Limited; Margaret A. Burke; Sam T. Yip

(57) ABSTRACT

This application relates to a vaporization device including a housing, a top cap and a heating assembly. The housing further has a storage chamber and a channel. The top cap further has a first top cap component and a second top cap component. The first top cap component has at least one through hole configured to suppress a flow rate of tobacco tar flowing from the storage chamber into the heating assembly.

25 Claims, 24 Drawing Sheets

VAPORIZATION DEVICE

CROSS REFERENCE TO RELATED APPLICATIONS

The present application claims the benefit of priority from the China Patent Application No. 201910980342.7, filed on Oct. 10, 2019, the disclosure of which is hereby incorporated by reference in its entirety.

BACKGROUND OF THE INVENTION

1. Technical Field

The present disclosure generally relates to a vaporization device, and more particularly to an electronic device for providing an inhalable aerial fog.

2. Description of the Related Art

An electronic cigarette is an electronic product that heats a vaporizable solution and vaporizes the solution to produce aerial fog for a user to inhale. In recent years, major manufacturers begin to produce various electronic cigarette products. Generally, an electronic cigarette product includes a housing, an e-liquid storage chamber, a vaporization chamber, a heating component, an air inlet, an airflow channel, an air outlet, a power supply device, a sensing device, and a control device. The air inlet is in communication with the vaporization chamber, and supplies air to the heating component when the user inhales. The aerial fog generated by the heating component is first generated in the vaporization chamber, then flows through the airflow channel and the air outlet, and is finally inhaled by the user. The power supply device supplies power needed by the heating component, and the control device controls the heating time of the heating component according to an inhalation action of the user detected by the sensing device. The housing wraps all the foregoing components.

An existing electronic smoke product in the market has a biggest problem, such as tar leakage of a cartridge, burnt smell or no smoke. In Most of solutions, an air inlet and an air outlet on both sides are used to block, or the user is educated to throw out leakage. However, the problem cannot be resolved fundamentally using these solutions, and leads to very poor user experience.

Therefore, a vaporization device which can resolve the above problem is provided.

SUMMARY OF THE INVENTION

Some embodiments of this application provide a vaporization device. The provided vaporization device includes a housing having a storage chamber, a top cap disposed in the housing and interconnected with the storage chamber, and a heating assembly disposed in the housing and engaged with and interconnected with the top cap. The top cap further includes a first top cap component and a second top cap component that are engaged with and are interconnected with each other. The first top cap component may be connected to the storage chamber, and the second top cap component may be connected to the heating assembly. The first top cap component has a first through hole, the first through hole having a first side wall and a second side wall opposite to the first side wall. A first baffle is formed at a location that is on the first through hole and that is close to the storage chamber and extends from the first side wall for protruding. A second baffle is formed at a location that is on the first through hole and that is close to the second top cap component and extends from the second side wall for protruding.

Other aspects and embodiments of the present disclosure are also expected. The above summary and the following detailed description are not intended to limit the present disclosure to any particular embodiment, but are merely intended to describe some embodiments of the present disclosure.

BRIEF DESCRIPTION OF THE DRAWINGS

For a better understanding of the essence and objectives of some embodiments of the present disclosure, reference is made to the following embodiments in conjunction with the accompanying drawings. In the drawings, similar reference numerals represent similar components unless the context explicitly indicates otherwise.

DETAILED DESCRIPTION

Figure 1A:
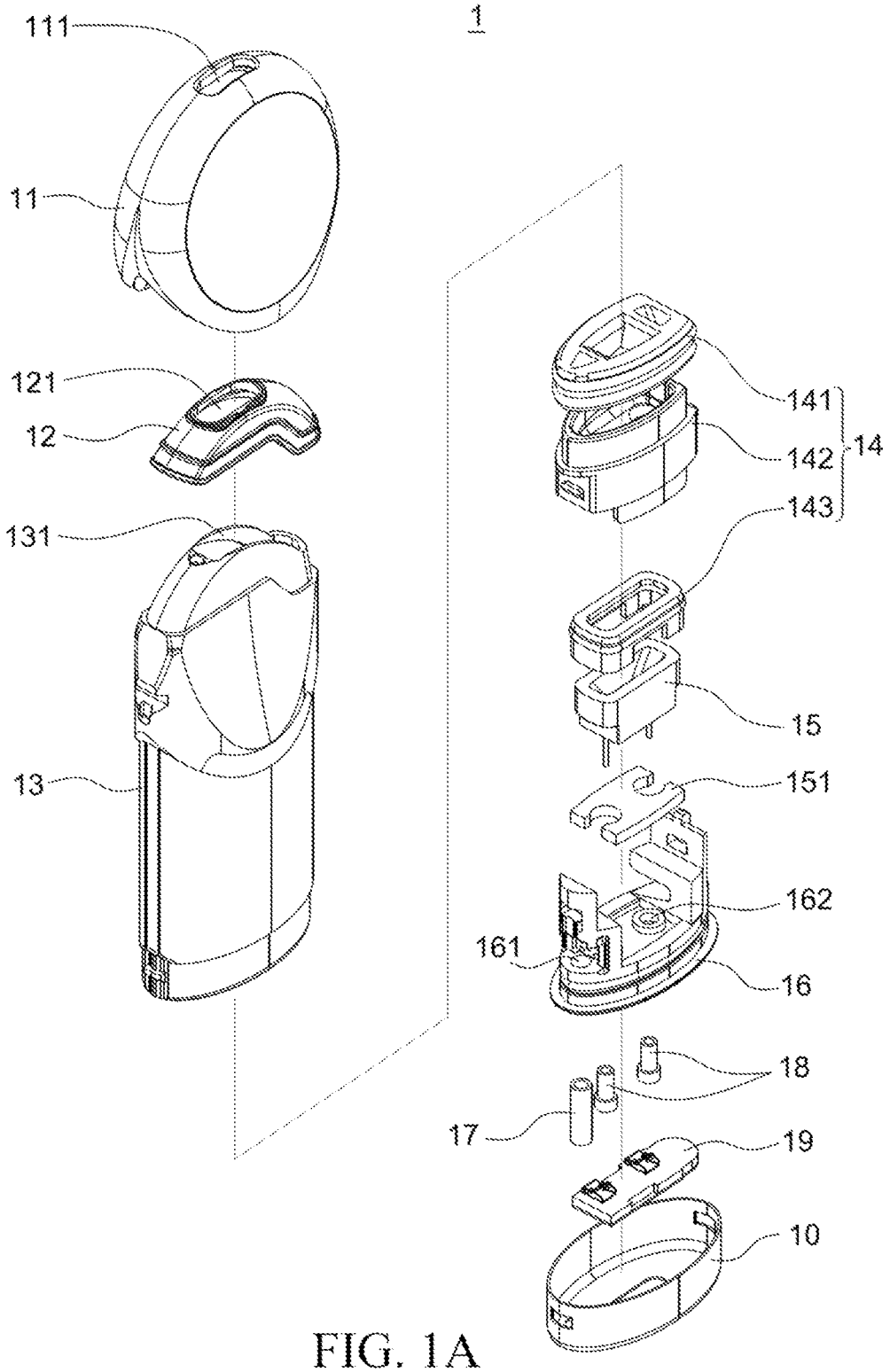
FIG. 1A and FIG. 1B are schematic diagrams of disassembled structures of a cartridge according to some embodiments of this application.

The following disclosed content provides many different embodiments or examples of different features used to implement the provided subject matters. The following describes particular examples of components and deployments. Certainly, these are merely examples and are not intended to be limitative. In the disclosure, in the following descriptions, reference formed by the first feature above or on the second feature may include an embodiment formed by direct contact between the first feature and the second feature, and may further include an embodiment in which an additional feature may be formed between the first feature and the second feature to enable the first feature and the second feature to be not in direct contact. In addition, in the present disclosure, reference numerals and/or letters may be repeated in examples. This repetition is for the purpose of simplification and clarity, and does not indicate a relationship between the described various embodiments and/or configurations.

The embodiments of the disclosure are described in detail below. However, it should be understood that, the disclosure provides many applicable concepts that can be implemented in various particular cases. The described particular embodiments are only illustrative and do not limit the scope of the disclosure.

In some embodiments of this application, an electronic vaporizer device is also referred to as an electronic cigarette. The electronic vaporizer device includes an electronic vaporizer device body and an electronic vaporizer, the electronic vaporizer device body being also referred to as a tobacco rod (not shown), and the electronic vaporizer being also referred to as a cartridge 1. In some embodiments of this application, the cartridge and the tobacco rod are separated structural components, and the cartridge is connected to the tobacco rod in a pluggable manner. The cartridge is engaged with the tobacco rod to form an electronic cigarette. In some embodiments of this application, the cartridge and the tobacco rod may be integrally formed structural components.

Figure 1B:
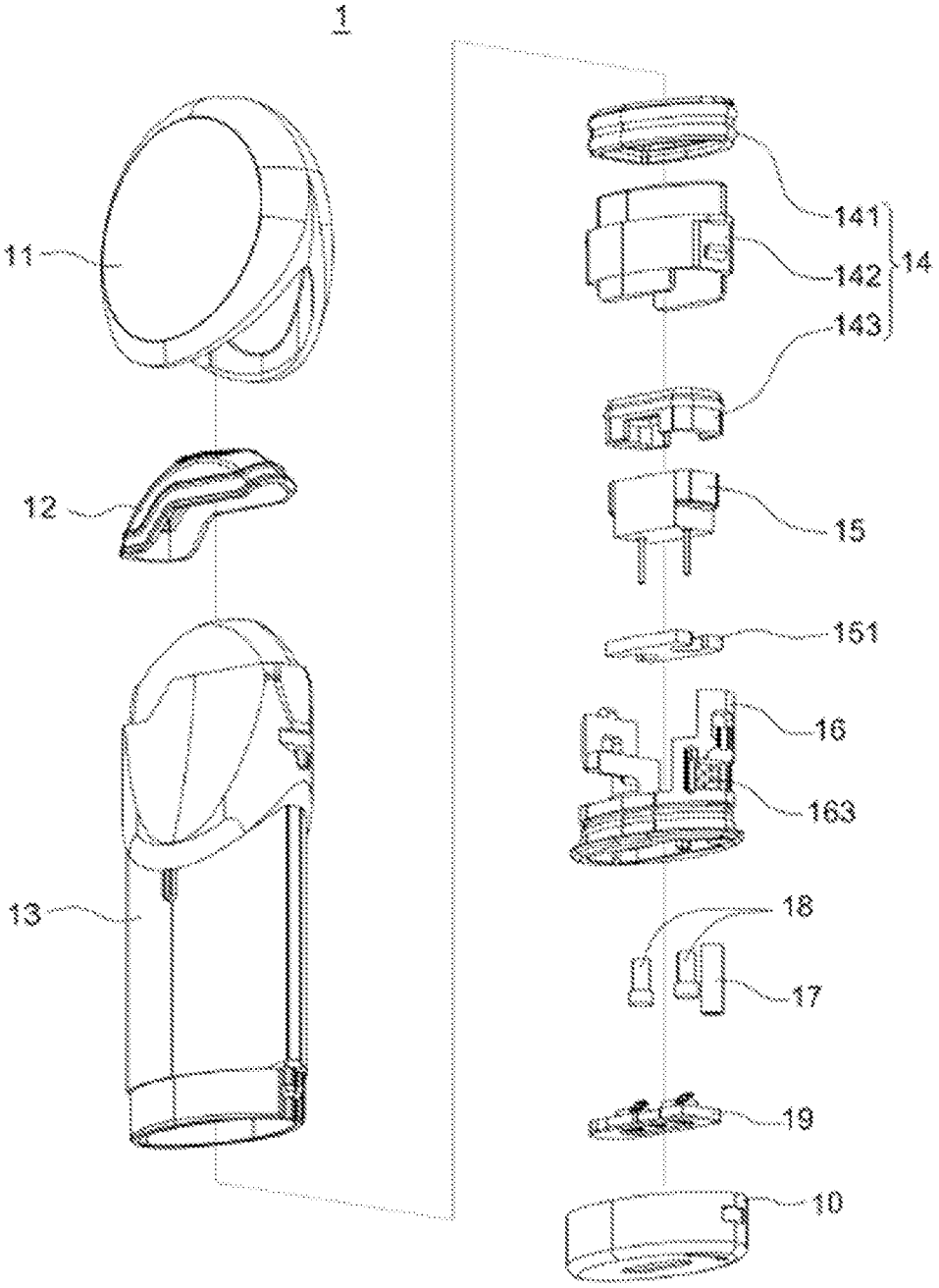

FIG. 1A and FIG. 1B are schematic diagrams of disassembled structures of a cartridge 1 according to some embodiments of this application. The cartridge 1 includes a mouthpiece (mouthpiece) 11, a cap 12, a housing 13, a top cap 14, a heating component 15, a heating base 16, a tube 17, an ejector pin 18, a printed circuit board (PCB) module 19 and a bottom cap 10. In some embodiments, the heating component 15 and the heating base 16 may form a heating assembly in some embodiments of this application. In some embodiments, the heating component 15, the ejector pin 18, and the PCB module 19 form a heating circuit in some embodiments of this application. In some embodiments, a resistor (not shown) indicating taste information of the cartridge 1 is disposed on the PCB module 19. In some embodiments, an encryption chip (not shown) is further disposed on the PCB module 19.

In some embodiments of this application, the cartridge 1 further includes a tar absorbing pad 151 located below the heating component 15. The tar absorbing pad 151 may be configured to absorb tobacco tar that may leak. A material of the tar absorbing pad 151 is macromolecule cotton, but may be selected according to an actual situation and is not limited thereto. Both sides of the tar absorbing pad 151 are provided with through holes or openings, the through holes or openings wrapping an outer wall of an upper half portion of the ejector pin 18.

The heating base 16 includes a hole 161, two holes 162, and a plurality of holes 163. The hole 161 is configured to accommodate the tube 17. When the cartridge 1 is assembled, the PCB module 19 is separated from the tube 17, and the PCB module 19 is not in direct contact with the tube 17. The two holes 162 are respectively configured to accommodate one ejector pin 18. Through the plurality of holes 163, the tube 17 may be in fluid communication with space in which a lower surface of the heating component 15, the tar absorbing pad 151, and the ejector pin 18 are located.

In some embodiments, the mouthpiece 11 has a hole 111, the cap 12 has a hole 121, and the housing 13 has a hole 131. When the mouthpiece 11, the cap 12, and the housing 13 are engaged with each other, the hole 111, the hole 121, and the hole 131 are in fluid communication with each other. A user may inhale gas containing a vaporized substance (for example, tobacco tar) from the hole 111 of the mouthpiece 11.

Referring to FIG. 1A and FIG. 1B, in some embodiments, the top cap 14 has a first top cap component 141, a second top cap component 142, and a third top cap component 143. The third top cap component 143 may be a heating sealing element. In some embodiments, the first top cap component 141, the second top cap component 142, and the third top cap component 143 are made of different materials. In some embodiments, the first top cap component 141 and the third top cap component 143 may be made of a same material. In some embodiments, the second top cap component 142 is made of a material different from that of the first top cap component 141 and the third top cap component 143.

The first top cap component 141 may be made of silica gel. The third top cap component 143 may be made of silica gel. The second top cap component 142 may be made of plastics. Material hardness of the second top cap component 142 may be higher than that of the first top cap component 141. Material hardness of the second top cap component 142 may be higher than that of the third top cap component 143.

The material hardness of the second top cap component 142 may be within a range from 65 A to 75 A of a Shore hardness type A. The material hardness of the second top cap component 142 may be within a range from 75 A to 85 A of a Shore hardness type A. The material hardness of the second top cap component 142 may be within a range from 85 A to 90 A of a Shore hardness type A. The material hardness of the first top cap component 141 may be within a range from 20 A to 40 A of a Shore hardness type A. The material hardness of the first top cap component 141 may be within a range from 40 A to 60 A of a Shore hardness type A. The material hardness of the first top cap component 141 may be within a range from 60 A to 75 A of a Shore hardness type A. The material hardness of the third top cap component 143 may be within a range from 20 A to 40 A of a Shore hardness type A. The material hardness of the third top cap component 143 may be within a range from 40 A to 60 A of a Shore hardness type A. The material hardness of the third top cap component 143 may be within a range from 60 A to 75 A of a Shore hardness type A.

The first top cap component 141, the second top cap component 142, and the third top cap component 143 of the top cap 14 may be combined together by later assembly. Therefore, assembly misalignment and a part tolerance problem may occur among the first top cap component 141, the second top cap component 142, and the third top cap component 143, further leading to a leakage risk (for example, tobacco tar leakage). A bonding force between the first top cap component 141 and the second top cap component 142 tends to be 0 N (that is, 0 Newton). A bonding force between the third top cap component 143 and the second top cap component 142 tends to be 0 N. For example, the mutually combined first top cap component 141 and the second top cap component 142 may be easily separated. The mutually combined second top cap component 142 and the third top cap component 143 may be easily separated.

When the first top cap component 141 is engaged with the second top cap component 142, the first top cap component 141 surrounds a portion of the second top cap component 142. When the second top cap component 142 is engaged with the third top cap component 143, a portion of the second top cap component 142 surrounds the third top cap component 143.

When the top cap 14 is engaged with the housing 13, an inner surface of the housing 13 surrounds the first top cap component 141. When the top cap 14 is engaged with the heating component 15, the third top cap component 143 surrounds the heating component 15.

In some embodiments, an upper surface of the heating component 15 includes a groove. In some embodiments, the lower surface of the heating component 15 has two pins, each of the two pins of the heating component 15 being coupled with a corresponding ejector pin 18. The ejector pin 18 may be coupled with the PCB module 19.

Figure 2A:
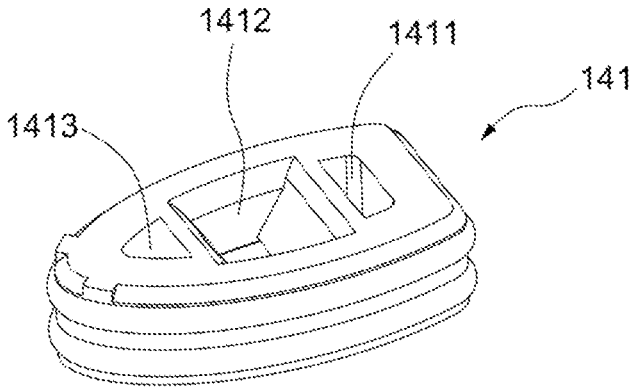
FIG. 2A is a three-dimensional schematic diagram of a top cap component according to some embodiments of this application.
Figure 2B:
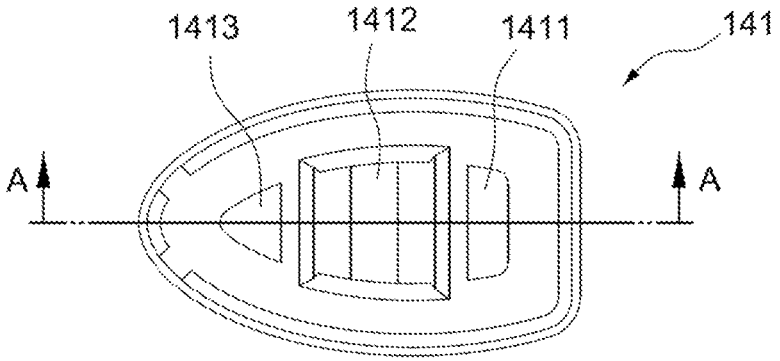
FIG. 2B is a schematic top view of a top cap component according to some embodiments of this application.
Figure 2C:
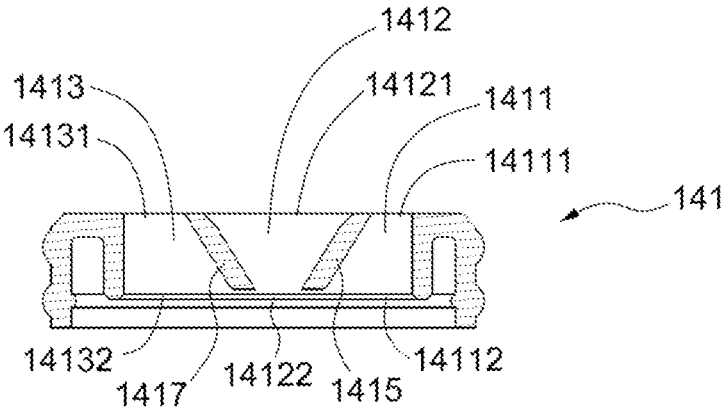
FIG. 2C is a schematic diagram of a cross-sectional structure of a top cap component according to some embodiments of this application.

FIG. 2A is a three-dimensional schematic diagram of a first top cap component 141 according to some embodiments of this application. FIG. 2B is a schematic top view of a first top cap component 141 according to some embodiments of this application. FIG. 2C is a schematic diagram of a cross-sectional structure of a first top cap component 141 according to some embodiments of this application. As shown in FIG. 2A, FIG. 2B, and FIG. 2C, the first component 141 has a first through holes 1411, a second through hole 1412, and a third through hole 1413 penetrating through a body of the first top cap component 141. Referring to FIG. 2C, FIG. 2C is a cross-sectional view of FIG. 2B taken along a line A-A. The first top cap component 141 has a first plate 1415 and a second plate 1417. The first and second plates 1415 and 1417 are formed in an inner cavity of the first top cap component 141, to substantially divide the inner cavity of the first top cap component 141 into the first, second and third through holes 1411, 1412, and 1413. Because of configuration of the first and second plates 1415 and 1417, the formed first, second and third through holes 1411, 1412, and 1413 are not in a uniform inner diameter. An inner diameter of the first through hole 1411 gradually tapers from bottom to top, an inner diameter of the second through hole 1412 gradually tapers from top to bottom, and an inner diameter of the third through hole 1413 gradually tapers from bottom to top. Therefore, the cross-sectional area of a lower opening 14112 of the first through hole 1411 is larger than that of an upper opening 14111 of the first through hole 1411, the cross-sectional area of an upper opening 14121 of the second through hole 1412 is larger than that of a lower opening 14121 of the second through hole 1412, and the cross-sectional area of a lower opening 14132 of the third through hole 1413 is larger than that of an upper opening 14131 of the third through hole 1413. In addition, the first, second and third through holes 1411, 1412, and 1413 are not completely separated from each other, and the first, second and third through hole 1411, 1412, and 1413 are at least partially in fluid communication with each other. As shown in FIG. 2C, there are voids below lower ends of the first and second plates 1415 and 1417, and through the voids, the first, second and third through holes 1411, 1412, and 1413 can be in fluid communication with each other.

Figure 3A:
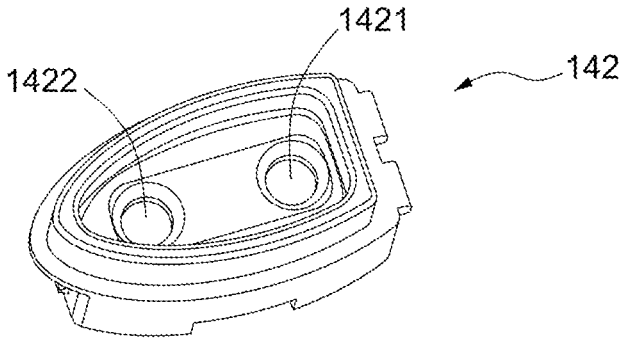
FIG. 3A is a three-dimensional schematic diagram of a top cap component according to some embodiments of this application.
Figure 3B:
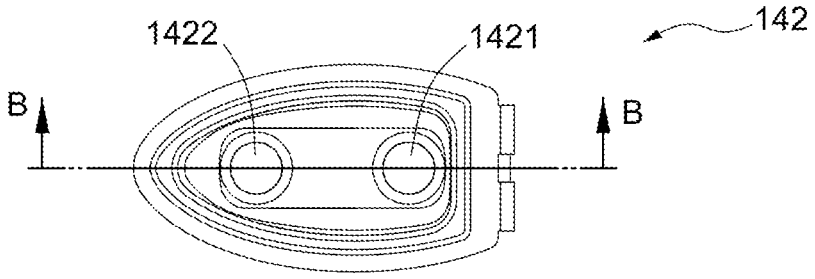
FIG. 3B is a schematic top view of a top cap component according to some embodiments of this application.
Figure 3C:
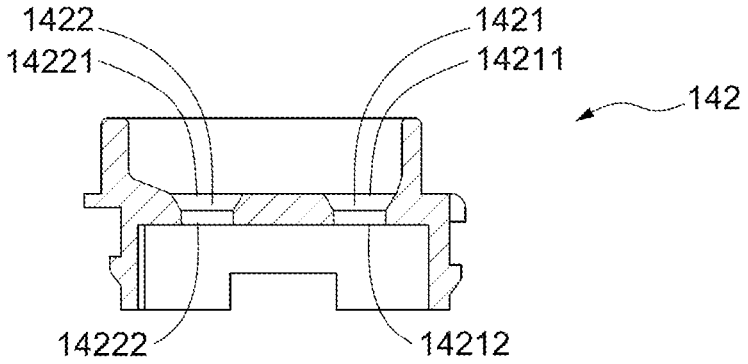
FIG. 3C is a schematic diagram of a cross-sectional structure of a top cap component according to some embodiments of this application.

FIG. 3A is a three-dimensional schematic diagram of a second top cap component 142 according to some embodiments of this application. FIG. 3B is a schematic top view of a second top cap component 142 according to some embodiments of this application. FIG. 3C is a schematic diagram of a cross-sectional structure of a second top cap component 142 according to some embodiments of this application. As shown in FIG. 3A, FIG. 3B, and FIG. 3C, the second top cap component 142 has a first through hole 1421 and a second through hole 1422 each penetrating through a body of the second top cap component 142. Referring to FIG. 3C, FIG. 3C is a cross-sectional view of FIG. 3B taken along a line B-B. The first through hole 1421 has an upper opening 14211 and a lower opening 14212. The second through hole 1422 has an upper opening 14221 and a lower opening 14222. When a first top cap component 141 and the second top cap component 142 are assembled, first and third through holes 1411 and 1413 of the first top cap component 141 each substantially correspond to the first and second through holes 1421 and 1422 of the second top cap component 142. Further, a lower opening 14112 of the first through hole 1411 of the first top cap component 141 is substantially aligned with an upper opening 14211 of the first through hole 1421 of the second top cap component 142, and a lower opening 14132 of the third through hole 1413 of the first top cap component 141 is substantially aligned with an upper opening 14221 of the second through hole 1422 of the second top cap component 142.

Figure 4:
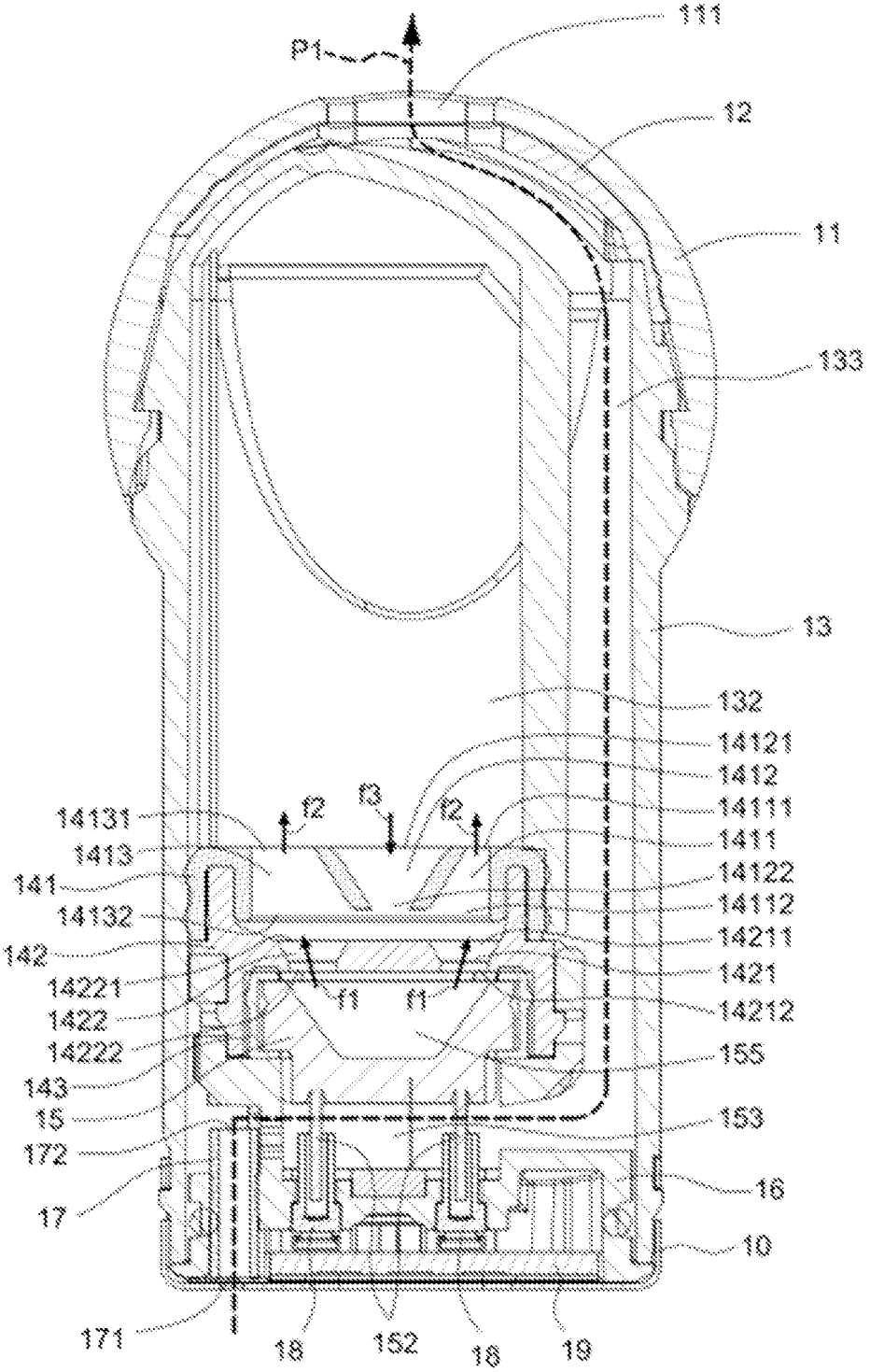
FIG. 4 is a schematic diagram of a cross-sectional structure of a cartridge according to some embodiments of this application.

FIG. 4 is a schematic diagram of a cross-sectional structure of a cartridge 1 according to some embodiments of this application. A housing 13 includes a storage chamber 132. The storage chamber 132 is configured to store a to-be-vaporized fluid substance, such as tobacco tar. A top cap 14 (including a first top cap component 141, a second top cap component 142, and a third top cap component 143) is engaged with the housing 13. In some embodiments, the housing 13 and the top cap 14 define the storage chamber 132. When the top cap 14 is engaged with the housing 13, an inner surface of the housing 13 surrounds the first top cap component 141 of the top cap 14. In some embodiments, the housing 13 defines the storage chamber 132. When the top cap 14 is engaged with the housing 13, an inner surface of the storage chamber 132 surrounds the first top cap component 141 of the top cap 14. The top cap 14 (including the first top cap component 141, the second top cap component 142, and the third top cap component 143) is engaged with a heating component 15. When the top cap 14 is engaged with the heating component 15, the third top cap component 143 of the top cap 14 surrounds the heating component 15.

The first top cap component 141 of the top cap 14 has the first, second and third through holes 1411, 1412, and 1413, and the second top cap component 142 has the first and second through holes 1421 and 1422. An upper surface of the heating component 15 has a groove. The second top cap component 142 and the upper surface of the heating component 15 define a cavity 155.

The storage chamber 132 is in fluid communication with the first, second and third through holes 1411, 1412, and 1413. The first, second and third through holes 1411, 1412, and 1413 are in fluid communication with the first through hole 1421 and the second through hole 1422. The first, second and third through holes 1411, 1412 and 1413 are in fluid communication with the cavity 155 through the first and second through holes 1421 and 1422. Therefore, the storage chamber 132, the first, second and third through holes 1411, 1412, and 1413, and the first and second through holes 1421 and 1422 are in fluid communication with the cavity 155. A ratio of the cross-sectional area of the first through hole 1421 or the second through hole 1422 to the cross-sectional area of the storage chamber 132 is substantially from 1:15 to 1:20. Further, a cross-sectional diameter of the first through hole 1421 or the second 1422 is about 1.7 mm.

The heating component 15 includes two pins 152. The pins 152 are coupled with an ejector pin 18. A tube 17 extends from a bottom cap 10 toward the heating component 15. The tube 17 includes two ends. The two ends of the tube 17 each have an opening 171 and an opening 172. The tube 17 extends and partially penetrates through a heating base 16. A hole 161 (as shown in FIG. 1A) of the heating base 16 accommodates the tube 17. The opening 171 of the tube 17 defines an opening on a bottom surface of the heating base 16. The opening 171 of the tube 17 is exposed on the bottom surface of the heating base 16. The heating base 16 includes the opening 171 of the tube 17. A through hole 101 of the bottom cap 10 exposes the opening 171. The opening 171 and the opening 172 of the tube 17 are in fluid communication with the outside.

Still referring to FIG. 4, an inner diameter of the first through hole 1411 of the first top cap component 141 gradually tapers from bottom to top, an inner diameter of the second through hole 1412 gradually tapers from top to bottom, and an inner diameter of the third through hole 1413 gradually tapers from bottom to top. Therefore, the cross-sectional area of a lower opening 14112 of the first through hole 1411 is larger than that of an upper opening 14111 of the first through hole 1411, the cross-sectional area of an upper opening 14121 of the second through hole 1412 is larger than that of a lower opening 14121 of the second through hole 1412, and the cross-sectional area of a lower opening 14132 of the third through hole 1413 is larger than that of an upper opening 14131 of the through hole 1413. In addition, the first and third through holes 1411 and 1413 of the first top cap component 141 each substantially correspond to the first and second through holes 1421 and 1422 of the second top cap component 142. Therefore, the lower opening 14112 of the first through hole 1411 of the first top cap component 141 is substantially aligned with an upper opening 14211 of the first through hole 1421 of the second top cap component 142, and the lower opening 14132 of the third through hole 1413 of the first top cap component 141 is substantially aligned with an upper opening 14221 of the second through hole 1422 of the second top cap component 142.

A dashed arrow in FIG. 4 shows an outlet passage P1 of the cartridge 1. Outside fluid (such as air) flows in from the opening 171 of the tube 17, passes through the tube 17, and flows out from the opening 172 of the tube 17. The air flowing out from the opening 172 of the tube 17 passes through a plurality of holes 163 (as shown in FIG. 1B) of the heating base 16 and flows to a vaporization chamber 153. The vaporization chamber 153 is defined by a lower portion of the heating component 15, the pins 152, and the ejector pin 18. The lower portion of the heating component 15 is exposed in the vaporization chamber 153. Aerial fog generated by heating of the heating component 15 is mixed with air, and the aerial fog mixed with air flows through a passage 133 of the housing 13 to a hole 131 (as shown in FIG. 1A) of the housing 13 and a hole 121 (as shown in FIG. 1A) of a cap 12, and then flows to a hole 111 of a mouthpiece 11 to be sucked by a user.

When the cartridge 1 is used, tobacco tar stored in the storage chamber 132 may first flows into the cavity 155 through the first, second and third through hole 1411, 1412 or 1413 of the first top cap component 141 and the first and second through hole 1421 or 1422 of the second top cap component 142. Subsequently, the heating component 15 may start heating the tobacco tar flowing into the cavity 155. When the tobacco tar in the cavity 155 is heated, aerial fog is generated. A portion of the aerial fog enters the passage 133 of the housing 13 along with air entering from the outside to further enter the hole 121 of the cap 12 and the hole 111 of the mouthpiece 11, so that the portion of the aerial fog is sucked by the user. However, if a flow rate at which the tobacco tar flows from the storage chamber 132 to the cavity 155 is too fast, an excessive amount of tobacco tar flows into the cavity 155. In this way, it is likely to cause situations such as tar leakage of the cartridge, a burnt smell, or no smoke. Therefore, some embodiments of this application provide the first, second and third through holes 1411, 1412, and 1413 of the first top cap component 141 and the first and second through holes 1421 and 1422 of the second top cap component 142. The first, second and third through holes 1411, 1412, and 1413 of the first top cap component 141 and the first and second through holes 1421 and 1422 of the second top cap component 142 are configured to suppress the flow rate at which the tobacco tar flows from the storage chamber 132 to the cavity 155, to prevent the excessive amount of tobacco tar from flowing into the cavity 155. Therefore, the above technical problems can be resolved.

As described above, when the heating component 15 may start heating the tobacco tar flowing into the cavity 155, a portion of smoke produced by the tobacco tar enters the passage 133 of the housing 13 along with air entering from the outside, while another portion of the smoke becomes a bubble that flows into the first and third through holes 1411 and 1413 of the first top cap component 141 through the first and second through holes 1421 and 1422 of the second top cap component 142 (see an arrow f1). When the bubble formed by the portion of the smoke flows into the first and third through holes 1411 and 1413, because the inner diameters of the first and third through holes 1411 and 1413 gradually tapers from bottom to top, and due to a pressure applied by remaining tobacco tar in the storage chamber 132, the bubble may be initially blocked at the opening 14111 of the first through hole 1411 and the opening 14131 of the third through hole 1413, and does not continue to flow upward into the storage chamber 132. Further, because the opening 14111 of the first through hole 1411 and the opening 14131 of the third through hole 1413 are blocked by the bubble, the tobacco tar in the storage chamber 132 does not continue to flow into the cavity 155. When the heating component 15 continues to heat the tobacco tar in the cavity 155, the heated tobacco tar may produce an increasing number of bubbles to flow into the first and third through holes 1411 and 1413. When the increasing number of bubbles are blocked and accumulated in the opening 14111 of the first through hole 1411 and the opening 14131 of the third through hole 1413, and when a pressure formed by the accumulated bubbles is greater than the pressure applied by the remaining tobacco tar in the storage chamber 132, the bubbles continue to flow upward into the storage chamber 132 through the opening 14111 of the first through hole 1411 and the opening 14131 of the third through hole 1413 (see an arrow f2). Once the bubbles flow upward into the storage chamber 132 through the opening 14111 of the first through hole 1411 and the opening 14131 of the third through hole 1413, the remaining tobacco tar in the storage chamber 132 flows downward into the second through hole 1412 of the first top cap component 141 (see an arrow f3) and further flows into the cavity 155 through the first and second through holes 1421 and 1422 of the second top cap component 142 to be heated by the heating component 15, so as to continue to produce smoke that can be inhaled by the user.

In the foregoing way, the flow rate at which the tobacco tar in the storage chamber 132 flows to the cavity 155 can be effectively suppressed to prevent the excessive amount of tobacco tar from flowing into the cavity 155.

Figure 5A:
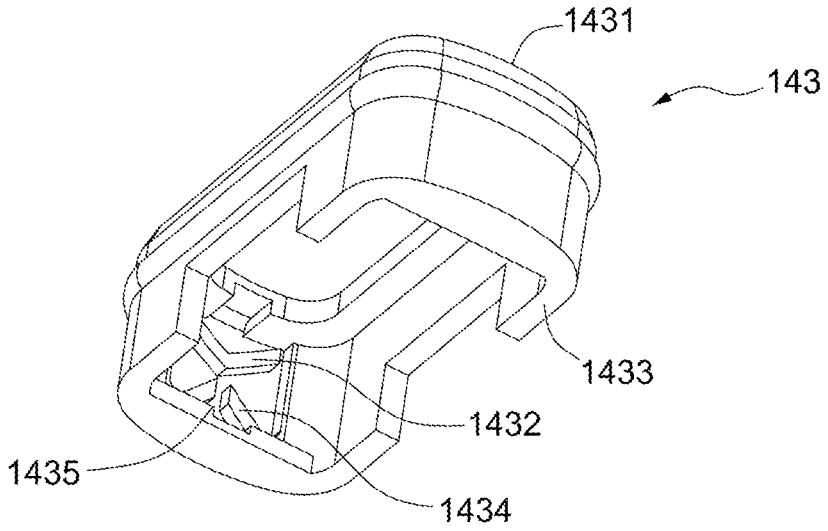
FIG. 5A is a three-dimensional view of a top cap component according to some embodiments of this application.
Figure 5B:
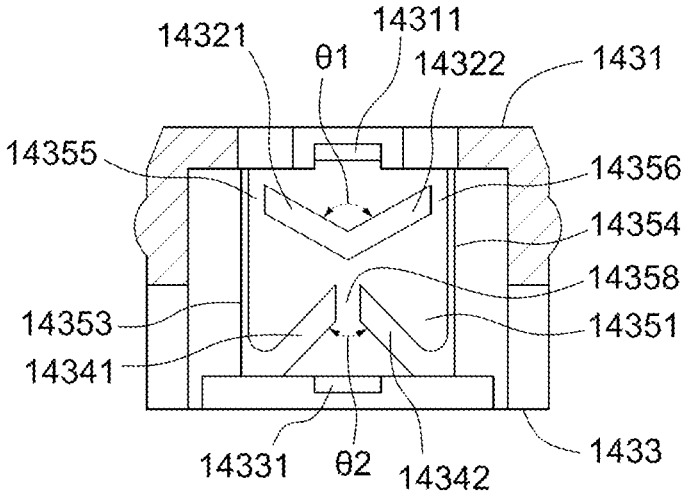
FIG. 5B is a schematic diagram of a side wall of a top cap component according to some embodiments of this application.
Figure 5C:
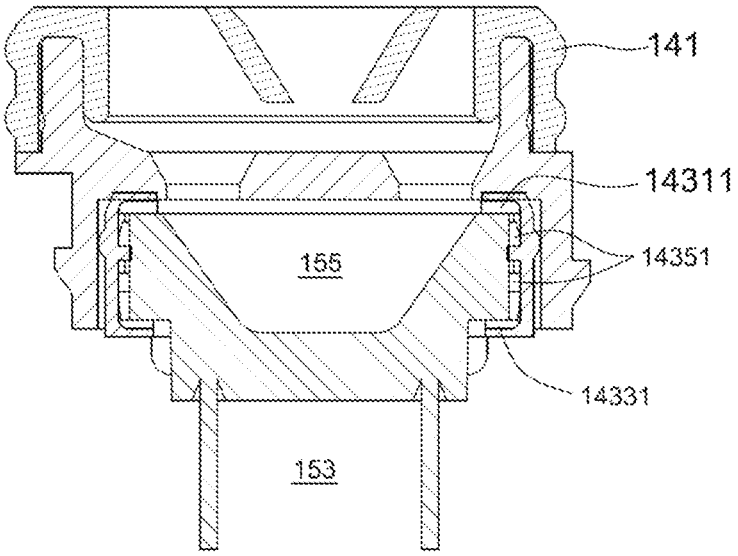
FIG. 5C is a partial cross-sectional diagram of a cartridge according to some embodiments of this application.
Figure 5D:
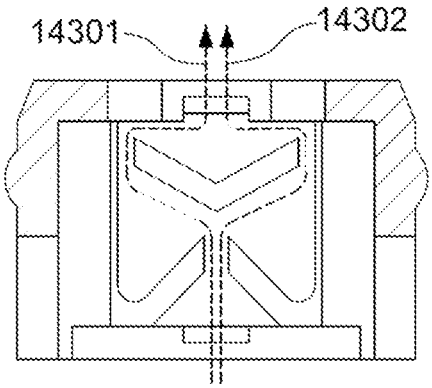
FIG. 5D is a schematic diagram of a side wall of a top cap according to some embodiments of this application.

FIG. 5A is a three-dimensional view of a top cap component according to some embodiments of this application. FIG. 5B is a schematic diagram of a side wall of a top cap component according to some embodiments of this application. FIG. 5C is a partial cross-sectional diagram of a cartridge according to some embodiments of this application. FIG. 5D is a schematic diagram of a side wall of a top cap component according to some embodiments of this application.

As described above, the component 143 may be a sealing element. As shown in FIG. 5A, FIG. 5B, and FIG. 5C, the component 143 has a top 1431, a bottom 1433 and a side wall 1435 extending between the top 1431 and the bottom 1433. The side wall 1435 has a groove 14351. The top 1431 of the component 143 has a groove 14311. The bottom 1433 of the component 143 has a groove 14331.

The side wall 1435 includes a partition 1432. The partition 1432 includes a segment 14321 and a segment 14322, one end of the segment 14321 being directly connected to one end of the segment 14322. The other end of the segment 14321 and one side 14353 of the groove 14351 form a gap 14355. The other end of the segment 14322 and the other side 14354 of the groove 14351 form a gap 14356. In some embodiments, an angle between the segment 14321 and the segment 14322 is between 90 degrees to 180 degrees. In some embodiments, an angle between the segment 14321 and the segment 14322 is between 90 degrees to 120 degrees. In some embodiments, an angle between the segment 14321 and the segment 14322 is between 120 degrees to 150 degrees. In some embodiments, an angle between the segment 14321 and the segment 14322 is between 150 degrees to 180 degrees. In some embodiments, the segment 14321 and the segment 14322 form a V shape with an opening upward (for example, a vertically upward direction shown in FIG. 5B).

The side wall 1435 of the component 143 further includes a partition 1434. The second partition 1434 includes a segment 14341 and a segment 14342. A gap 14358 is formed between the segment 14341 and the segment 14342. There is an angle between the segment 14341 and the segment 14342. In some embodiments, the angle between the segment 14341 and the segment 14342 may be different from the angle between the segment 14321 and the segment 14322. In some embodiments, the angle between the segment 14341 and the segment 14342 may be the same as the angle between the segment 14321 and the segment 14322. In some embodiments, the segment 14341 and the segment 14342 form an inverted V shape with an opening downward (for example, a vertically downward direction shown in FIG. 5B).

When the component 143 covers the heating component 15, at least one cavity (or referred to as a ventilation channel) is defined among the partition 1432, the partition 1434, the groove 14351, and the heating component 15. In particular, a ventilation channel 14301 (as shown in FIG. 5D) may be defined among the groove 14331, the gap 14358, the gap 14355, and the groove 14311. A vaporization chamber 153 may be in fluid communication with a storage chamber (the storage chamber 132 shown in FIG. 4) through the ventilation channel 14301. A ventilation channel 14302 (as shown in FIG. 5D) may be defined among the groove 14331, the gap 14358, the gap 14356, and the groove 14311. A vaporization chamber 153 may be in fluid communication with a storage chamber (the storage chamber 132 shown in FIG. 4) through the ventilation channel 14302.

As a user continues to use a vaporization device, a vaporizable material in the storage chamber 132 is continuously consumed and reduced so that a pressure in the storage chamber 132 is gradually reduced. If the pressure in the storage chamber 132 is reduced, a negative pressure may be generated. If the pressure in the storage chamber 132 is reduced, the vaporizable material (for example, tobacco tar) may be unlikely to flow into a cavity 155 of the heating component 15 through passages 1421 and 1422. When the cavity 155 does not completely absorb the vaporizable material, the high-temperature heating component 15 may burn drily and generate a scorched smell.

The foregoing situations can be improved by disposing a ventilation channel in the side wall of the component 143. The ventilation channel (a flowing direction shown by arrows in FIG. 5D) formed in the side wall of the component 143 may balance the pressure in the storage chamber 132.

Figure 6A:
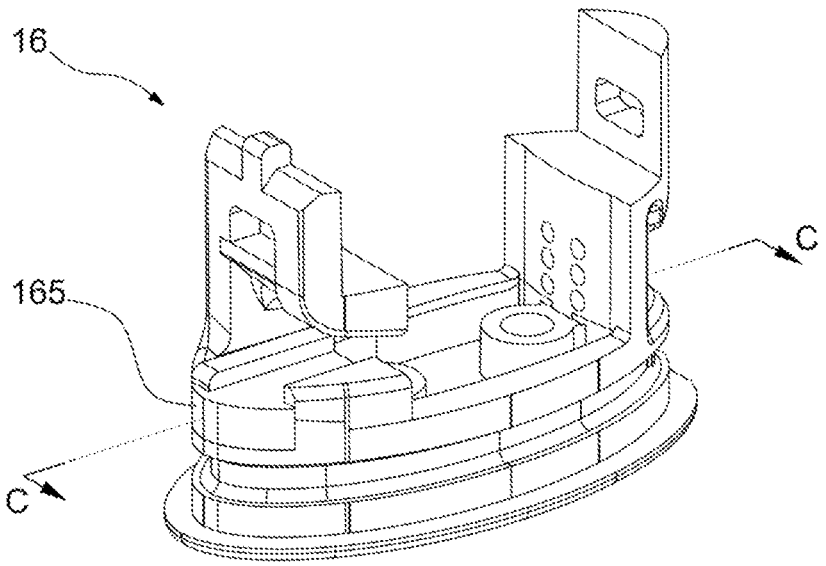
FIG. 6A is a three-dimensional schematic diagram of a heating base according to some embodiments of this application.
Figure 6B:
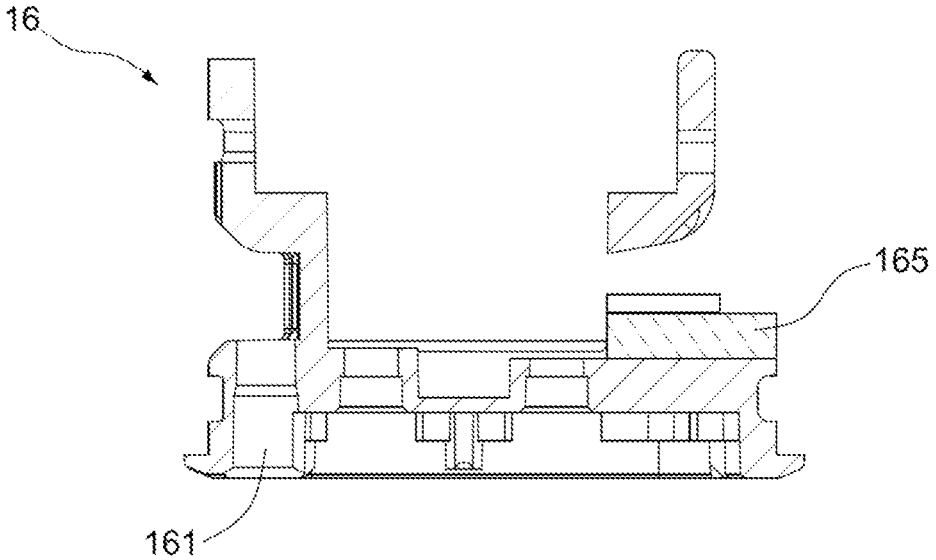
FIG. 6B is a schematic diagram of a cross-sectional structure of a heating base according to some embodiments of this application.

As described above, the cartridge 1 further includes a tar absorbing pad 151 located below the heating component 15. The tar absorbing pad 151 may be configured to absorb tobacco tar that may leak (see FIG. 1A). However, when the user inhales, air passes through the passage P1 as shown in FIG. 3. When the air passes through the vaporization chamber 153, vaporized tobacco tar is mixed with cold air to condense the vaporized tobacco tar, and tobacco tar incompletely absorbed by the tar absorbing pad 151 may spill out of the cartridge 1. In order to prevent the tobacco tar incompletely absorbed by the tar absorbing pad 151 from spilling out, the heating base 16 in some embodiments of this application further includes a tar absorbing pad 165 (see FIG. 6A). The tar absorbing pad 165 is disposed at an opposite end of one end at which a hole 161 is located (see FIG. 6B). A material of the tar absorbing pad 165 is macromolecule cotton, but may be selected according to an actual situation and is not limited thereto.

Figure 7A:
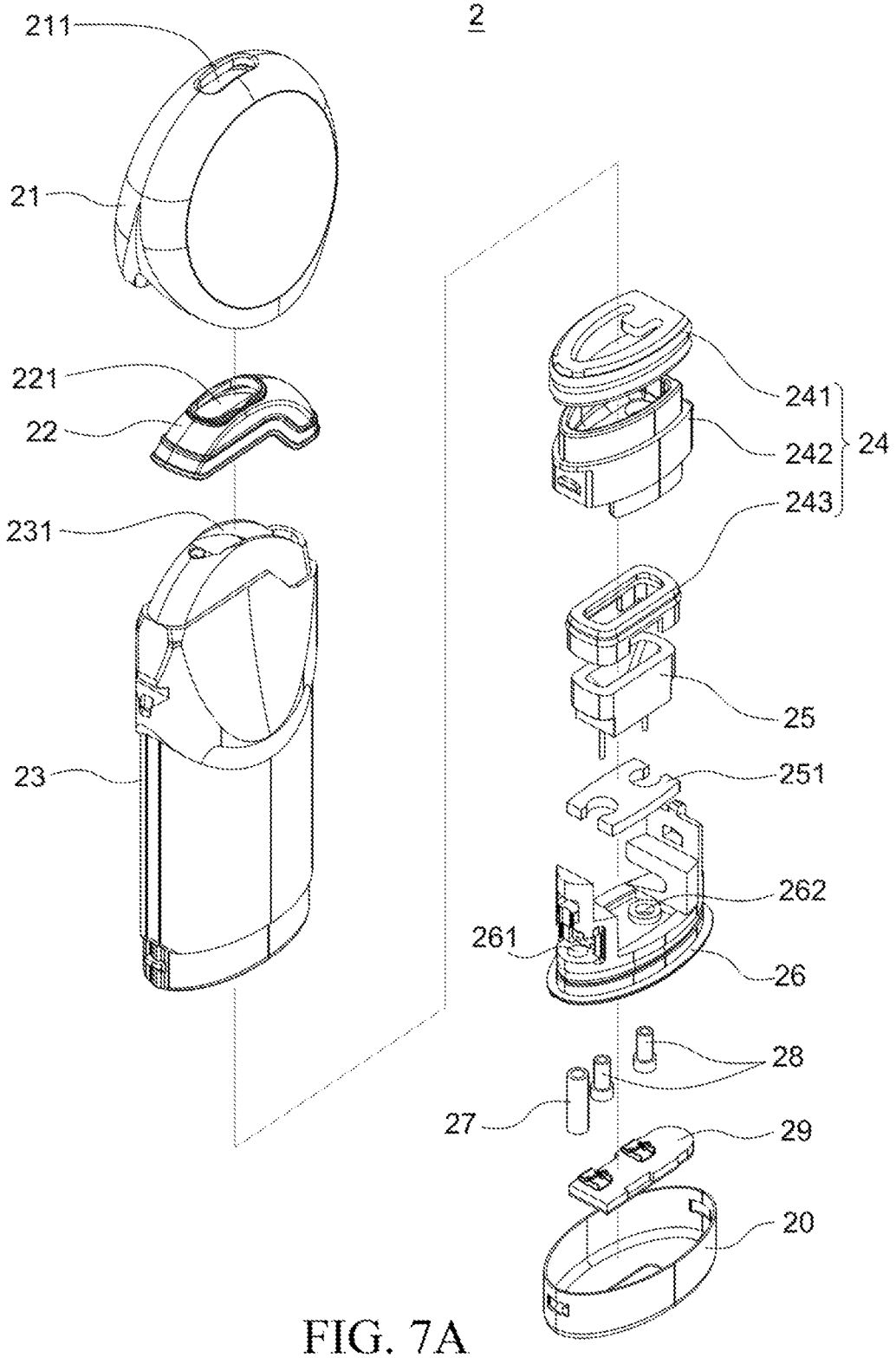
FIG. 7A and FIG. 7B are schematic diagrams of disassembled structures of a cartridge according to some embodiments of this application.
Figure 7B:
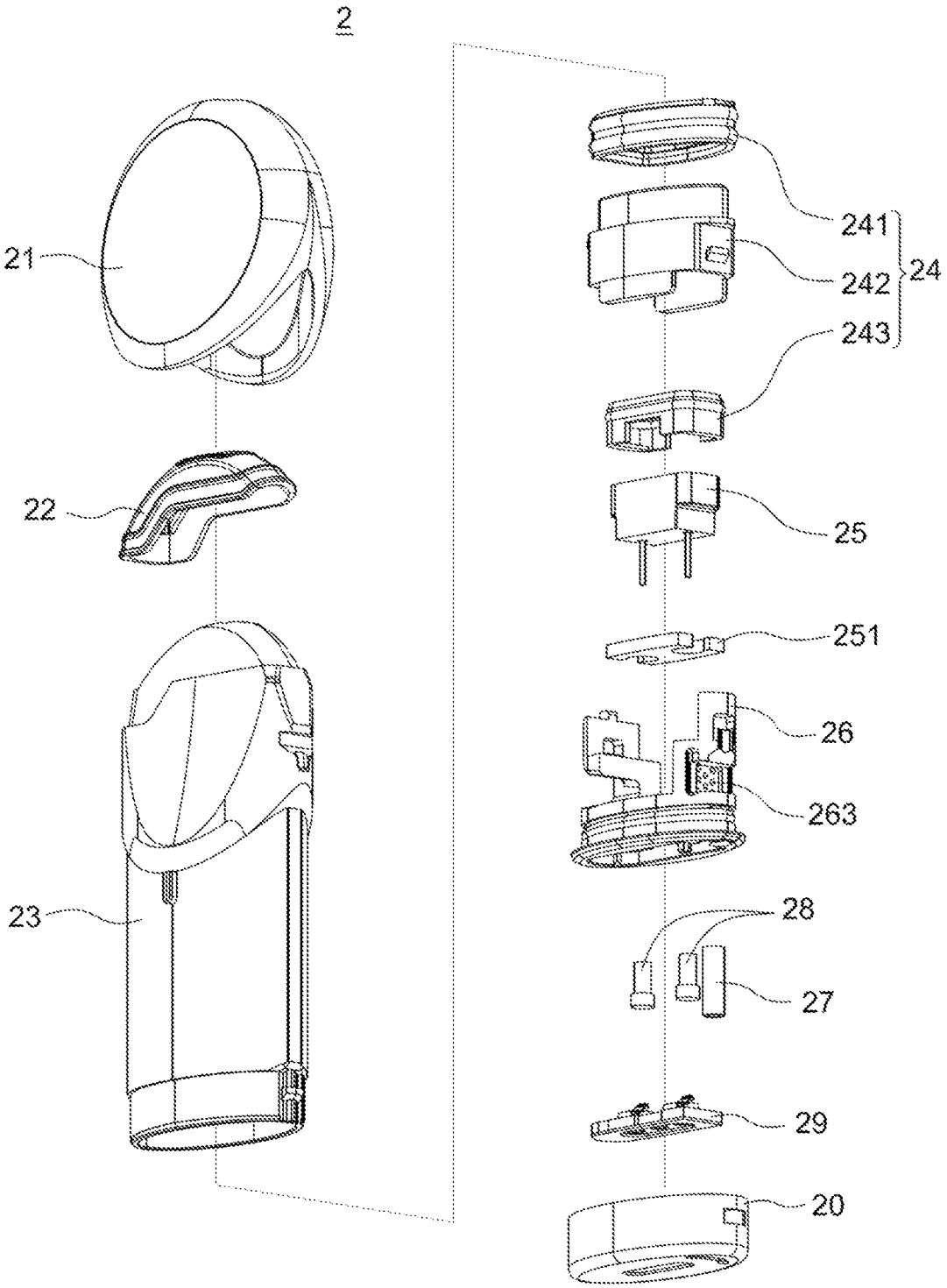

FIG. 7A and FIG. 7B are schematic diagrams of disassembled structures of a cartridge 2 according to some embodiments of this application. The cartridge 2 includes a mouthpiece (mouthpiece) 21, a cap 22, a housing 23, a top cap 24, a heating component 25, a heating base 26, a tube 27, an ejector pin 28, a printed circuit board (PCB) module 29 and a bottom cap 20. In some embodiments, the heating component 25 and the heating base 26 may form a heating assembly in some embodiments of this application. In some embodiments, the heating component 25, the ejector pin 28, and the PCB module 29 form a heating circuit in some embodiments of this application. In some embodiments, a resistor (not shown) indicating taste information of the cartridge 2 is disposed on the PCB module 29. In some embodiments, an encryption chip (not shown) is further disposed on the PCB module 29.

In some embodiments of this application, the cartridge 2 further includes a tar absorbing pad 251 located below the heating component 25. The tar absorbing pad 251 may be configured to absorb tobacco tar that may leak. A material of the tar absorbing pad 251 is macromolecule cotton, but may be selected according to an actual situation and is not limited thereto. Both sides of the tar absorbing pad 251 are provided with through holes or openings, the through holes or openings wrapping an outer wall of an upper half portion of the ejector pin 28.

The heating base 26 includes a hole 261, two holes 262, and a plurality of holes 263. The hole 261 is configured to accommodate the tube 27. When the cartridge 2 is assembled, the PCB module 29 is separated from the tube 27, and the PCB module 29 is not in direct contact with the tube 27. The two holes 262 are respectively configured to accommodate one ejector pin 28. Through the plurality of holes 263, the tube 27 may be in fluid communication with space in which a lower surface of the heating component 25, the tar absorbing pad 251, and the ejector pin 28 are located.

In some embodiments, the mouthpiece 21 has a hole 211, the cap 22 has a hole 221, and the housing 23 has a hole 231. When the mouthpiece 21, the cap 22, and the housing 23 are engaged with each other, the hole 211, the hole 221, and the hole 231 are in fluid communication with each other. A user may inhale gas containing a vaporized substance (for example, tobacco tar) from the hole 211 of the mouthpiece 21.

Referring to FIG. 7A and FIG. 7B, in some embodiments, the top cap 24 has a component 241, a component 242, and a component 243. The component 243 may be a heating sealing element. In some embodiments, the component 241, the component 242, and the component 243 are made of different materials. In some embodiments, the component 241 and the component 243 may be made of a same material. In some embodiments, the component 242 is made of a material different from that of the component 241 and the component 243.

The component 241 may be made of silica gel. The component 243 may be made of silica gel. The component 242 may be made of plastics. Material hardness of the component 242 may be higher than that of the component 241. Material hardness of the component 242 may be higher than that of the component 243.

The material hardness of the component 242 may be within a range from 65 A to 75 A of a Shore hardness type A. The material hardness of the component 242 may be within a range from 75 A to 85 A of a Shore hardness type A. The material hardness of the component 242 may be within a range from 85 A to 90 A of a Shore hardness type A. The material hardness of the component 241 may be within a range from 20 A to 40 A of a Shore hardness type A. The material hardness of the component 241 may be within a range from 40 A to 60 A of a Shore hardness type A. The material hardness of the component 241 may be within a range from 60 A to 75 A of a Shore hardness type A. The material hardness of the component 243 may be within a range from 20 A to 40 A of a Shore hardness type A. The material hardness of the component 243 may be within a range from 40 A to 60 A of a Shore hardness type A. The material hardness of the component 243 may be within a range from 60 A to 75 A of a Shore hardness type A.

The component 241, the component 242, and the component 243 of the top cap 24 may be combined together by later assembly. Therefore, assembly misalignment and a part tolerance problem may occur among the component 241, the component 242, and the component 243, further leading to a leakage risk (for example, tobacco tar leakage). A bonding force between the component 241 and the component 242 tends to be 0 N (that is, 0 Newton). A bonding force between the component 243 and the component 242 tends to be 0 N. For example, the mutually combined component 241 and the component 242 may be easily separated. The mutually combined component 242 and the component 243 may be easily separated.

When the component 241 is engaged with the component 242, the component 241 surrounds a portion of the component 242. When the component 242 is engaged with the component 243, a portion of the component 242 surrounds the component 243.

When the top cap 24 is engaged with the housing 23, an inner surface of the housing 23 surrounds the component 241. When the top cap 24 is engaged with the heating component 25, the component 243 surrounds the heating component 25.

In some embodiments, an upper surface of the heating component 25 includes a groove. In some embodiments, the lower surface of the heating component 25 has two pins, each of the two pins of the heating component 25 being coupled with a corresponding ejector pin 28. The ejector pin 28 may be coupled with the PCB module 29.

Figure 8A:
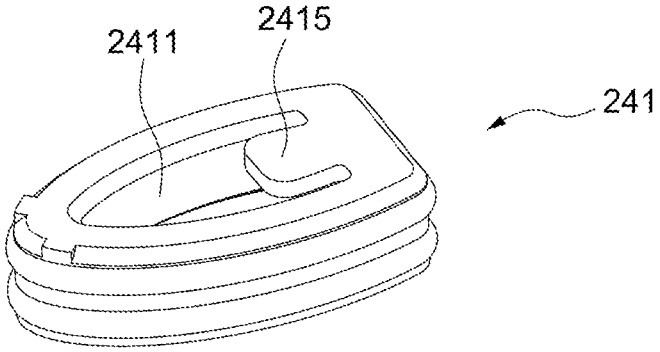
FIG. 8A is a three-dimensional schematic diagram of a top cap component according to some embodiments of this application.
Figure 8B:
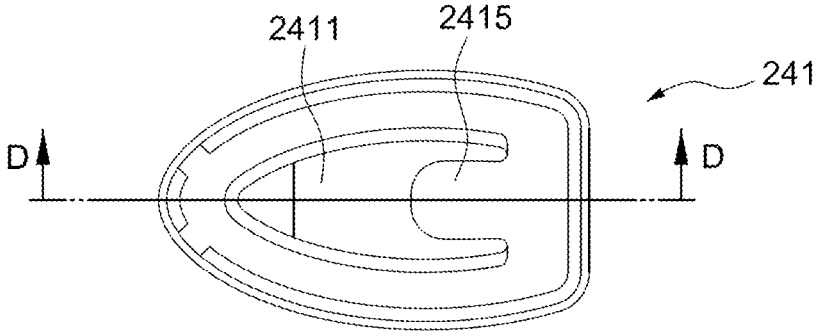
FIG. 8B is a schematic top view of a top cap component according to some embodiments of this application.
Figure 8C:
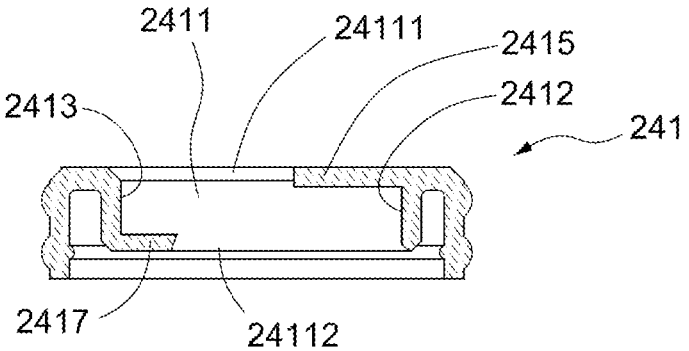
FIG. 8C is a schematic diagram of a cross-sectional structure of a top cap component according to some embodiments of this application.

FIG. 8A is a three-dimensional schematic diagram of a top cap component 241 according to some embodiments of this application. FIG. 8B is a schematic top view of a top cap component 241 according to some embodiments of this application. FIG. 8C is a schematic diagram of a cross-sectional structure of a top cap component 241 according to some embodiments of this application. As shown in FIG. 8A, FIG. 8B, and FIG. 8C, the component 241 has a through hole 2411 penetrating through a body of the component 241. Referring to FIG. 8C, FIG. 8C is a cross-sectional view of FIG. 8B taken along a line A-A. The through hole 2411 has two opposite inner walls: 2412 and 2413. A baffle 2415 extends substantially horizontally from the inner wall 2412 at an upper edge about of the inner wall 2412. A baffle 2417 extends substantially horizontally from the inner wall 2413 at a lower edge about of the inner wall 2413. It further indicates that the baffle 2415 is disposed substantially horizontally at an opening 24111 of the through hole 2411 and protrudes from the inner wall 2412 while the baffle 2417 is disposed substantially horizontally at an opening 24112 of the through hole 2411 and protrudes from the inner wall 2413. In this way, the baffles 2415 and 2417 are configured to form a circuitous channel like a Z shape in the through hole 2411. A vertical projection of the baffle 2415 does not overlap with the baffle 2417.

Figure 9A:
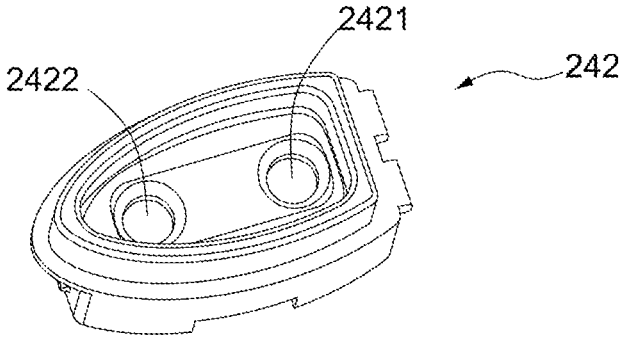
FIG. 9A is a three-dimensional schematic diagram of a top cap component according to some embodiments of this application.
Figure 9B:
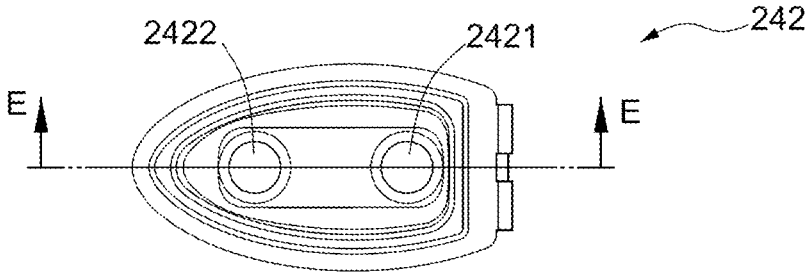
FIG. 9B is a schematic top view of a top cap component according to some embodiments of this application.
Figure 9C:
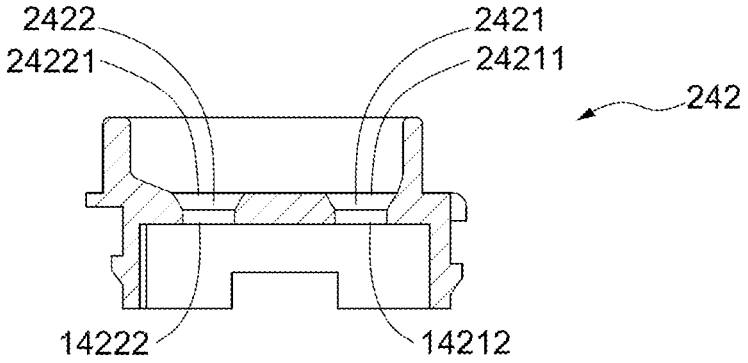
FIG. 9C is a schematic diagram of a cross-sectional structure of a top cap component according to some embodiments of this application.

FIG. 9A is a three-dimensional schematic diagram of a top cap component 242 according to some embodiments of this application. FIG. 9B is a schematic top view of a top cap component 242 according to some embodiments of this application. FIG. 9C is a schematic diagram of a cross-sectional structure of a top cap component 242 according to some embodiments of this application. As shown in FIG. 9A, FIG. 9B, and FIG. 9C, the component 242 has two through holes: 2421 and 2422 each penetrating through a body of the component 242. Referring to FIG. 9C, FIG. 9C is a cross-sectional view of FIG. 9B taken along a line B-B. The through hole 2421 has an upper opening 24211 and a lower opening 24212. The through hole 2422 has an upper opening 24221 and a lower opening 24222.

Figure 10:
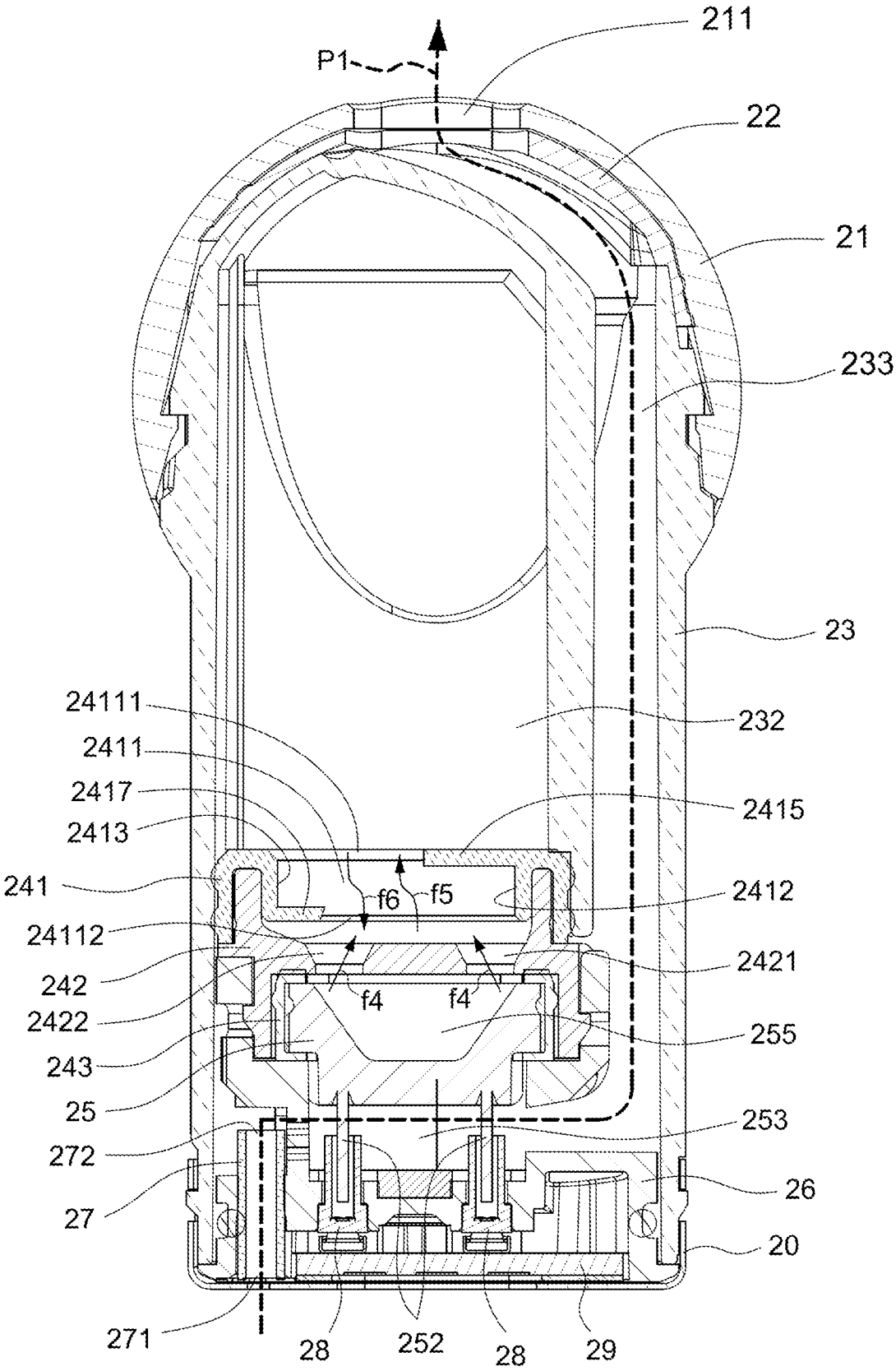
FIG. 10 is a schematic diagram of a cross-sectional structure of a cartridge according to some embodiments of this application.

FIG. 10 is a schematic diagram of a cross-sectional structure of a cartridge 2 according to some embodiments of this application. A housing 23 includes a storage chamber 232. The storage chamber 232 is configured to store a to-be-vaporized fluid substance, such as tobacco tar. A top cap 24 (including a component 241, a component 242, and a component 243) is engaged with the housing 23. In some embodiments, the housing 23 and the top cap 24 define the storage chamber 232. When the top cap 24 is engaged with the housing 23, an inner surface of the housing 23 surrounds the component 241 of the top cap 24. In some embodiments, the housing 23 defines the storage chamber 232. When the top cap 24 is engaged with the housing 23, an inner surface of the storage chamber 232 surrounds the component 241 of the top cap 24. The top cap 24 (including the component 241, the component 242, and the component 243) is engaged with a heating component 25. When the top cap 24 is engaged with the heating component 25, the component 243 of the top cap 24 surrounds the heating component 25.

The component 241 of the top cap 24 has a through hole 2411, while the component 242 has through holes 2421 and 2422. An upper surface of the heating component 25 has a groove. The component 242 and the upper surface of the heating component 25 define a cavity 255.

The storage chamber 232 is in fluid communication with the through hole 2411. The through hole 2411 is in fluid communication with a through hole 2421 and a through hole 2422. The through hole 2411 is in fluid communication with a cavity 255 through the through holes 2421 and 2422. Therefore, the storage chamber 232, the through hole 2411, and the through holes 2421 and 2422 are in fluid communication with the cavity 255. A ratio of the cross-sectional area of the through hole 2421 or 2422 to the cross-sectional area of the storage chamber 232 is substantially from 1:15 to 1:20. Further, a cross-sectional diameter of the through hole 2421 or 2422 is about 1.7 mm.

The heating component 25 includes two pins 252. The pins 252 are coupled with an ejector pin 28. A tube 27 extends from a bottom cap 20 toward the heating component 25. The tube 27 includes two ends. The two ends of the tube 27 each have an opening 271 and an opening 272. The tube 27 extends and partially penetrates through a heating base 26. A hole 261 (as shown in FIG. 7A) of the heating base 26 accommodates the tube 27. The opening 271 of the tube 27 defines an opening on a bottom surface of the heating base 26. The opening 271 of the tube 27 is exposed on the bottom surface of the heating base 26. The heating base 26 includes the opening 271 of the tube 27. A through hole 201 of the bottom cap 20 exposes the opening 271. The opening 271 and the opening 272 of the tube 27 are in fluid communication with the outside.

A dashed arrow in FIG. 10 shows an outlet passage P2 of a cartridge 2. Outside fluid (such as air) flows in from the opening 271 of the tube 27, passes through the tube 27, and flows out from the opening 272 of the tube 27. The air flowing out from the opening 272 of the tube 27 passes through a plurality of holes 263 (as shown in FIG. 7B) of the heating base 26 and flows to a vaporization chamber 253. The vaporization chamber 253 is defined by a lower portion of the heating component 25, the pins 252, and the ejector pin 28. The lower portion of the heating component 25 is exposed in the vaporization chamber 253. Aerial fog generated by heating of the heating component 25 is mixed with air, and the aerial fog mixed with air flows through a passage 233 of the housing 23 to a hole 231 (as shown in FIG. 7A) of the housing 23 and a hole 221 (as shown in FIG. 7A) of a cap 22, and then flows to a hole 211 of a mouthpiece 21 to be sucked by a user.

When the cartridge 2 is used, tobacco tar stored in the storage chamber 232 may first flows into the cavity 255 through the through hole 2411 of the component 241 and the through hole 2421 or 2422 of the component 242. Subsequently, the heating component 25 may start heating the tobacco tar flowing into the cavity 255. When the tobacco tar in the cavity 255 is heated, aerial fog is generated. A portion of the aerial fog enters the passage 233 of the housing 23 along with air entering from the outside to further enter the hole 221 of the cap 22 and the hole 211 of the mouthpiece 21, so that the portion of the aerial fog is sucked by the user. However, if a flow rate at which the tobacco tar flows from the storage chamber 232 to the cavity 255 is too fast, an excessive amount of tobacco tar flows into the cavity 255. In this way, it is likely to cause situations such as tar leakage of the cartridge, a burnt smell, or no smoke. Therefore, some embodiments of this application provide the through hole 2411 of the component 241 and the through holes 2421 and 2422 of the component 242. The through hole 2411 of the component 241 and the through holes 2421 and 2422 of the component 242 are configured to suppress a flow rate at which the tobacco tar flows from the storage chamber 232 to the cavity 255, to prevent the excessive amount of tobacco tar from flowing into the cavity 255. Therefore, the above technical problems can be resolved.

As described above, when the heating component 25 may start heating the tobacco tar flowing into the cavity 255, a portion of smoke produced by the tobacco tar enters the passage 233 of the housing 23 along with air entering from the outside, while another portion of the smoke becomes a bubble that flows into the through hole 2411 of the component 241 through the through holes 2421 and 2422 of the component 242 (see an arrow f4). When the bubble formed by the portion of the smoke flows into the through hole 2411, baffles 2415 and 2417 of the through hole 2411 are configured to form a Z-shaped circuitous path in the through hole 2411. Due to the Z-shaped circuitous path formed in the through hole 2411, the bubble needs to travel a longer path to pass through the through hole 2411 and further enter the storage chamber 232 (see an arrow f5). In this way, the bubble spends more time staying in the through hole 2411. Similarly, the tobacco tar flowing from the storage chamber 232 to the cavity also needs to pass through the Z-shaped circuitous path of the through hole 2411. In this way, the tobacco tar also travels a longer path to pass through the through hole 2411, further flows into the through holes 2421 and 2422 of the component 242, and further flows into the cavity 255 (see an arrow f6). Therefore, a flow rate at which the tobacco tar flows from the storage chamber 232 to the cavity 255 through the components 241 and 242 is reduced. Further, the bubble spends more time staying in the through hole 2411, and the bubble staying in the through hole 2411 partially prevents the tobacco tar from passing through the through hole 2411, which further reduces the flow rate at which the tobacco tar passes through the through hole 2411. Based on the foregoing, the baffles 2415 and 2417 of the through hole 2411 can effectively reduce a flow rate at which the tobacco tar flows from the storage chamber 232 to the cavity 255 through the components 241 and 242.

In the foregoing way, the flow rate at which the tobacco tar in the storage chamber 232 flows to the cavity 255 can be effectively suppressed to prevent the excessive amount of tobacco tar from flowing into the cavity 255.

Figure 11A:
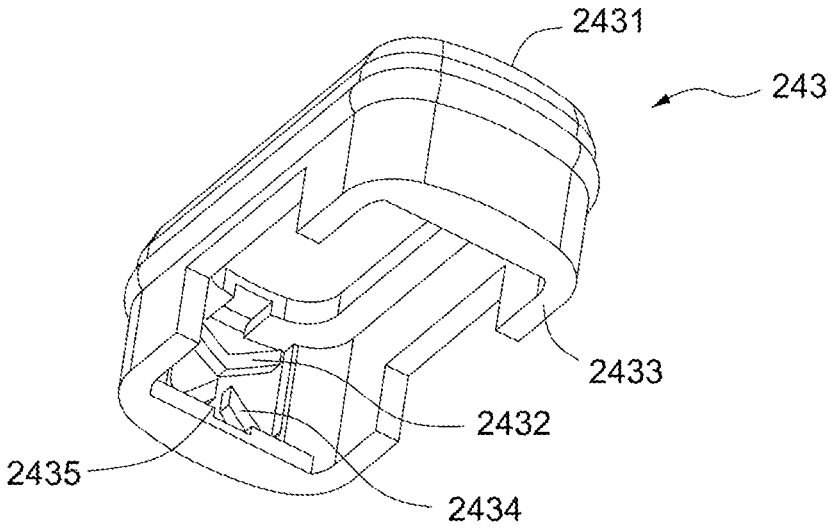
FIG. 11A is a three-dimensional view of a top cap component according to some embodiments of this application.
Figure 11B:
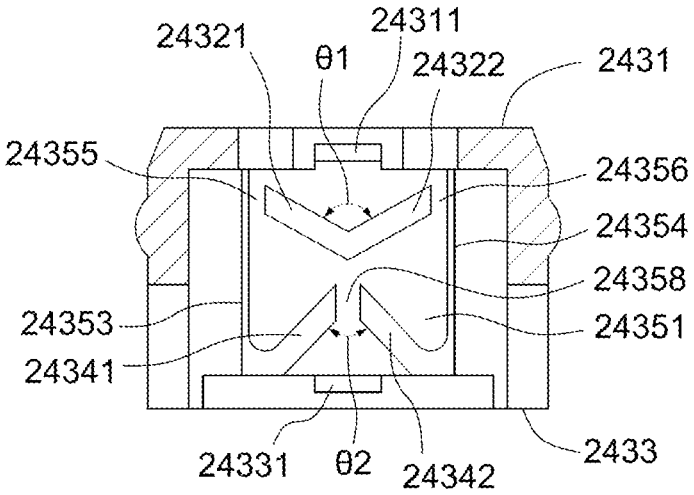
FIG. 11B is a schematic diagram of a side wall of a top cap component according to some embodiments of this application.
Figure 11C:
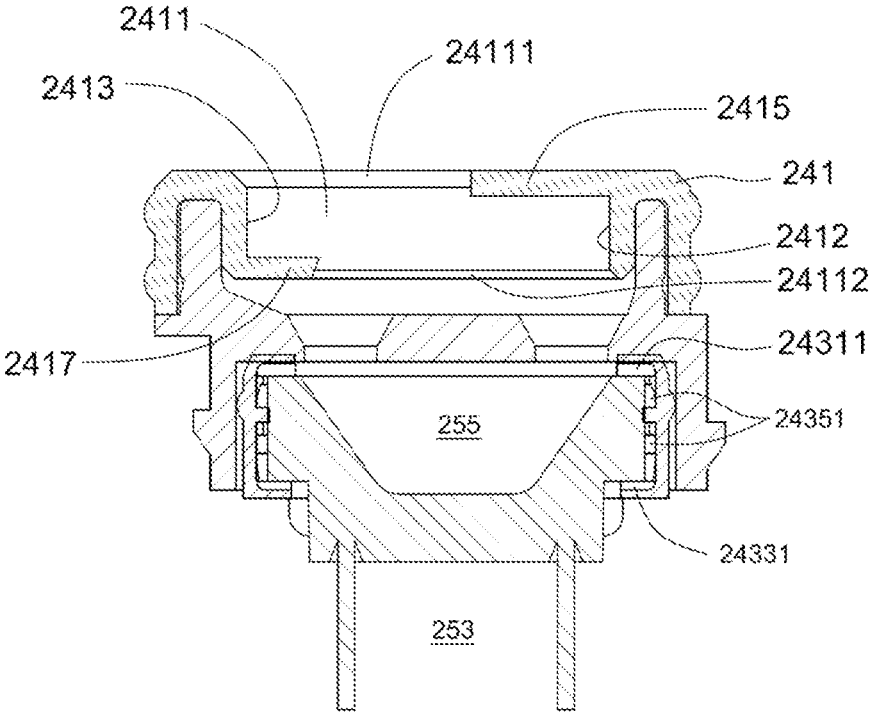
FIG. 11C is a partial cross-sectional diagram of a cartridge according to some embodiments of this application.
Figure 11D:
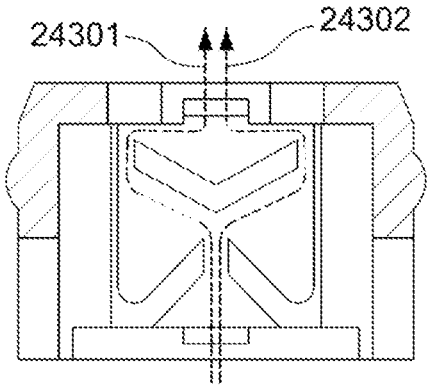
FIG. 11D is a schematic diagram of a side wall of a top cap according to some embodiments of this application.

FIG. 11A is a three-dimensional view of a top cap component according to some embodiments of this application. FIG. 11B is a schematic diagram of a side wall of a top cap component according to some embodiments of this application. FIG. 11C is a partial cross-sectional diagram of a cartridge according to some embodiments of this application. FIG. 11D is a schematic diagram of a side wall of a top cap component according to some embodiments of this application.

As described above, the component 243 may be a sealing element. As shown in FIG. 11A, FIG. 11B, and FIG. 11C, the component 243 has a top 2431, a bottom 2433, and a side wall 2435 extending between the top 2431 and the bottom 2433. The side wall 2435 has a groove 24351. The top 2431 of the component 243 has a groove 24311. The bottom 2433 of the component 243 has a groove 24331.

The side wall 2435 includes a partition 2432. The partition 2432 includes a segment 24321 and a segment 24322, one end of the segment 24321 being directly connected to one end of the segment 24322. The other end of the segment 24321 and one side 24353 of the groove 24351 form a gap 24355. The other end of the segment 24322 and the other side 24354 of the groove 24351 form a gap 24356. In some embodiments, an angle between the segment 24321 and the segment 24322 is between 90 degrees to 180 degrees. In some embodiments, an angle between the segment 24321 and the segment 24322 is between 90 degrees to 120 degrees. In some embodiments, an angle between the segment 23421 and the segment 24322 is between 120 degrees to 150 degrees. In some embodiments, an angle between the segment 24321 and the segment 24322 is between 150 degrees to 180 degrees. In some embodiments, the segment 24321 and the segment 24322 form a V shape with an opening upward (for example, a vertically upward direction shown in FIG. 11B).

The side wall 2435 of the component 243 further includes a partition 2434. The partition 2434 includes a segment 24341 and a segment 24342. A gap 24358 is formed between the segment 24341 and the segment 24342. There is an angle between the segment 24341 and the segment 24342. In some embodiments, the angle between the segment 24341 and the segment 24342 may be different from the angle between the segment 24321 and the segment 24322. In some embodiments, the angle between the segment 24341 and the segment 24342 may be the same as the angle between the segment 24321 and the segment 24322. In some embodiments, the segment 24341 and the segment 24342 form an inverted V shape with an opening downward (for example, a vertically downward direction shown in FIG. 11B).

When the component 243 covers the heating component 25, at least one cavity (or referred to as a ventilation channel) is defined among the partition 2432, the partition 2434, the groove 24351, and the heating component 25. In particular, a ventilation channel 24301 (as shown in FIG. 11D) may be defined among the groove 24331, the gap 24358, the gap 24355, and the groove 24311. A vaporization chamber 253 may be in fluid communication with a storage chamber (the storage chamber 232 shown in FIG. 10) through the ventilation channel 24301. A ventilation channel 24302 (as shown in FIG. 11D) may be defined among the groove 24331, the gap 24358, the gap 24356, and the groove 24311. A vaporization chamber 253 may be in fluid communication with a storage chamber (the storage chamber 232 shown in FIG. 10) through the ventilation channel 24302.

As a user continues to use a vaporization device, a vaporizable material in the storage chamber 232 is continuously consumed and reduced so that a pressure in the storage chamber 232 is gradually reduced. If the pressure in the storage chamber 232 is reduced, a negative pressure may be generated. If the pressure in the storage chamber 232 is reduced, the vaporizable material (for example, tobacco tar) may be unlikely to flow into a cavity 255 of the heating component 25 through passages 2421 and 2422. When the cavity 255 does not completely absorb the vaporizable material, the high-temperature heating component 25 may burn drily and generate a scorched smell.

The foregoing situations can be improved by disposing a ventilation channel in the side wall of the component 243. The ventilation channel (a flowing direction shown by arrows in FIG. 11D) formed in the side wall of the component 243 may balance pressure in the storage chamber 232.

As described above, the cartridge 2 further includes a tar absorbing pad 251 located below the heating component 25.

Figure 12A:
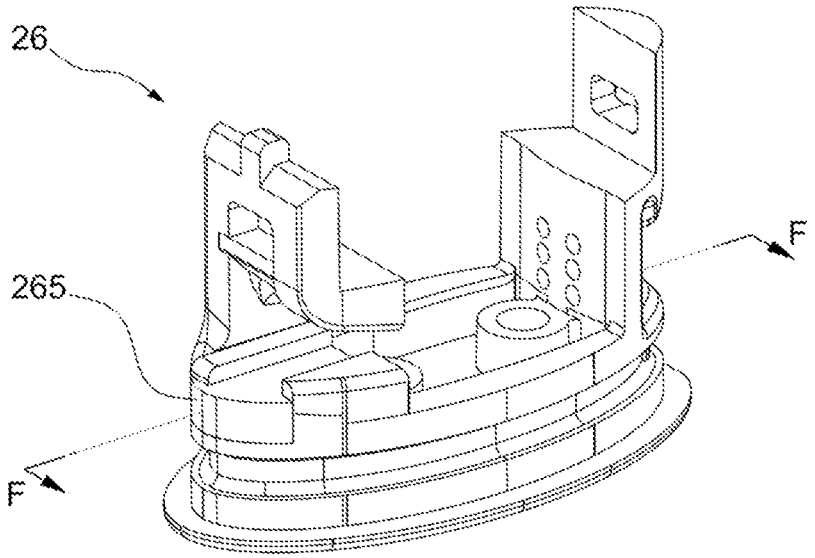
FIG. 12A is a three-dimensional schematic diagram of a heating base according to some embodiments of this application.
Figure 12B:
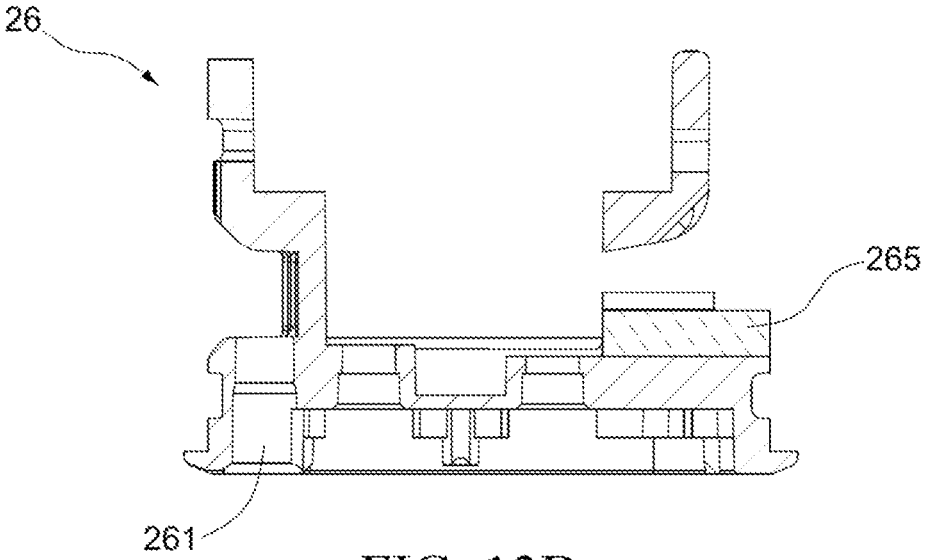
FIG. 12B is a schematic diagram of a cross-sectional structure of a heating base according to some embodiments of this application.

The tar absorbing pad 251 may be configured to absorb tobacco tar that may leak (see FIG. 7A). However, when the user inhales, air passes through the passage P2 as shown in FIG. 10. When the air passes through the vaporization chamber 253, vaporized tobacco tar is mixed with cold air, which may condense the vaporized tobacco tar, and tobacco tar incompletely absorbed by the tar absorbing pad 251 may spill out of the cartridge 2. In order to prevent the tobacco tar incompletely absorbed by the tar absorbing pad 251 from spilling out, the heating base 26 in some embodiments of this application further includes a tar absorbing pad 265 (see FIG. 12A). The tar absorbing pad 265 is disposed at an opposite end of one end at which an opposite hole 261 is located (see FIG. 12B). A material of the tar absorbing pad 265 is macromolecule cotton, but may be selected according to an actual situation and is not limited thereto.

Figure 13A:
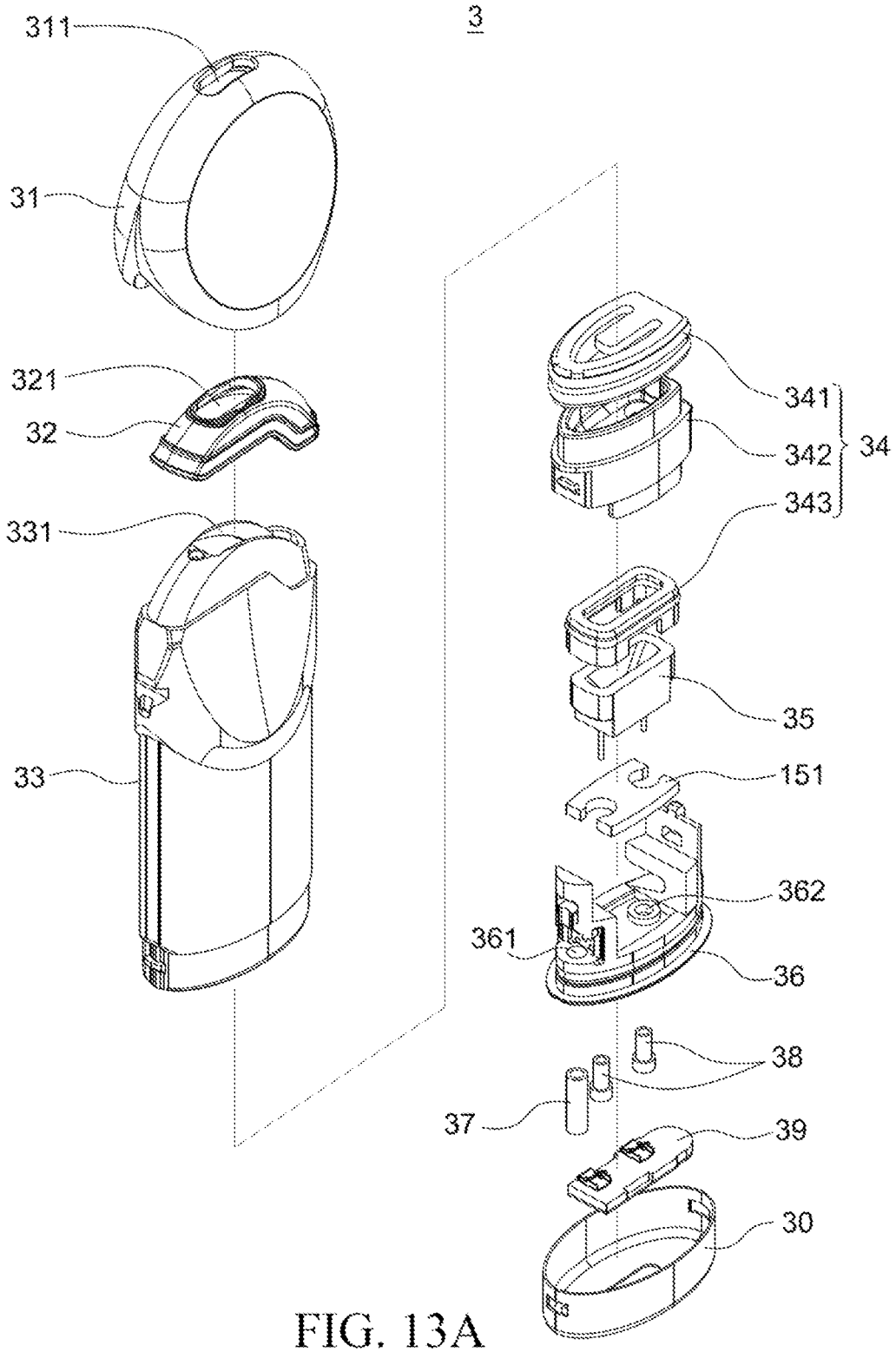
FIG. 13A and FIG. 13B are schematic diagrams of disassembled structures of a cartridge according to some embodiments of this application.
Figure 13B:
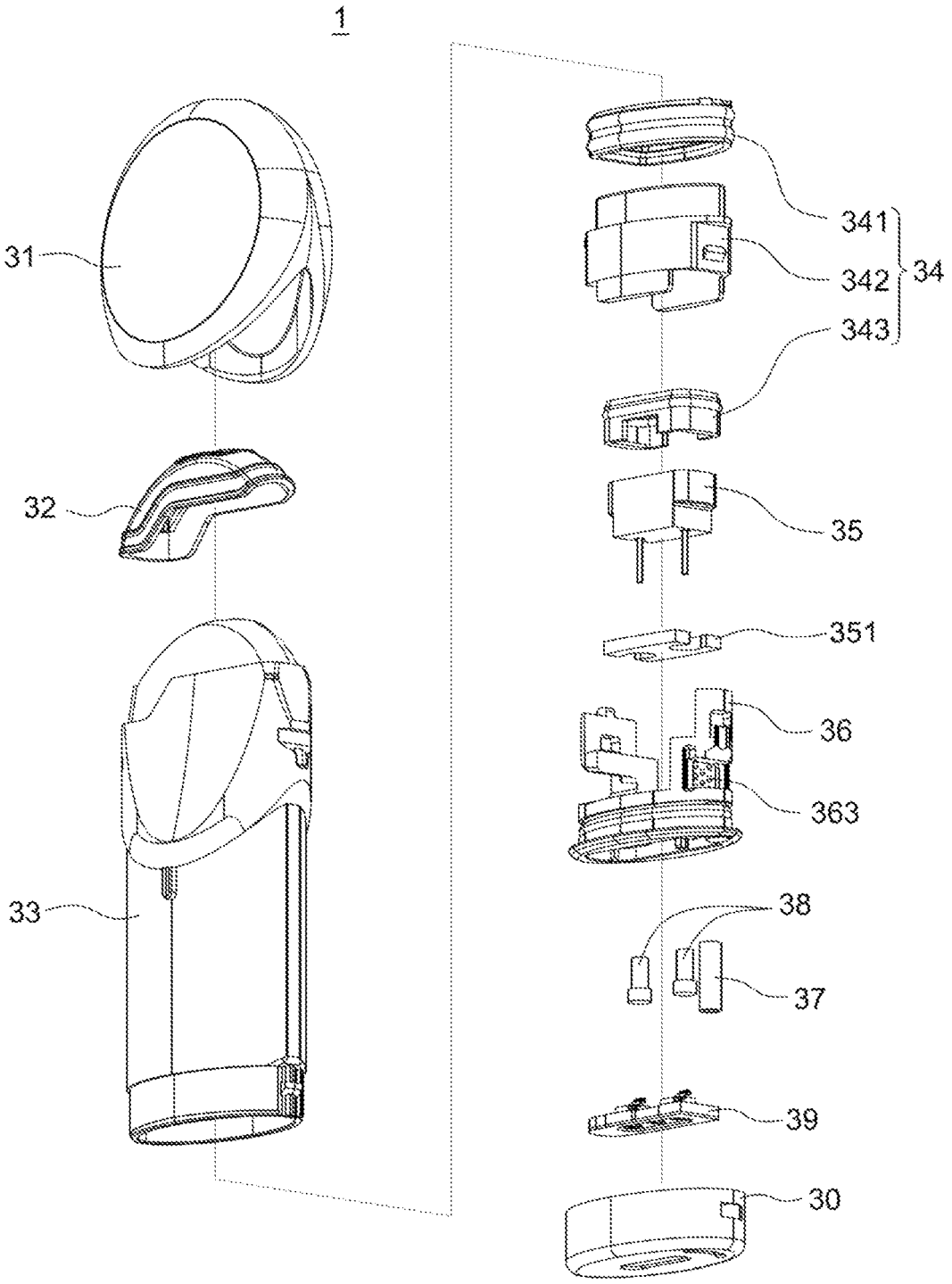

FIG. 13A and FIG. 13B are schematic diagrams of disassembled structures of a cartridge 3 according to some embodiments of this application. The cartridge 3 includes a mouthpiece (mouthpiece) 31, a cap 32, a housing 33, a top cap 34, a heating component 35, a heating base 36, a tube 37, an ejector pin 38, a printed circuit board (PCB) module 39 and a bottom cap 30. In some embodiments, the heating component 35 and the heating base 36 may form a heating assembly in some embodiments of this application. In some embodiments, the heating component 35, the ejector pin 38, and the PCB module 39 form a heating circuit in some embodiments of this application. In some embodiments, a resistor (not shown) indicating taste information of the cartridge 3 is disposed on the PCB module 39. In some embodiments, an encryption chip (not shown) is further disposed on the PCB module 39.

In some embodiments of this application, the cartridge 3 further includes a tar absorbing pad 351 located below the heating component 35. The tar absorbing pad 351 may be configured to absorb tobacco tar that may leak. A material of the tar absorbing pad 351 is macromolecule cotton, but may be selected according to an actual situation and is not limited thereto. Both sides of the tar absorbing pad 351 are provided with through holes or openings, the through holes or openings wrapping an outer wall of an upper half portion of the ejector pin 351.

The heating base 36 includes a hole 361, two holes 362, and a plurality of holes 363. The hole 361 is configured to accommodate the tube 37. When the cartridge 3 is assembled, the PCB module 39 is separated from the tube 37, and the PCB module 39 is not in direct contact with the tube 37. The two holes 362 are respectively configured to accommodate one ejector pin 38. Through the plurality of holes 363, the tube 37 may be in fluid communication with space in which a lower surface of the heating component 35, the tar absorbing pad 351, and the ejector pin 38 are located.

In some embodiments, the mouthpiece 31 has a hole 311, the cap 32 has a hole 321, and the housing 33 has a hole 331. When the mouthpiece 31, the cap 32, and the housing 33 are engaged with each other, the hole 311, the hole 321, and the hole 331 are in fluid communication with each other. A user may inhale gas containing a vaporized substance (for example, tobacco tar) from the hole 311 of the mouthpiece 31.

Referring to FIG. 13A and FIG. 13B, in some embodiments, the top cap 34 has a component 341, a component 342, and a component 343. The component 343 may be a heating sealing element. In some embodiments, the component 341, the component 342, and the component 343 are made of different materials. In some embodiments, the component 341 and the component 343 may be made of a same material. In some embodiments, the component 342 is made of a material different from that of the component 341 and the component 343.

The component 341 may be made of silica gel. The component 343 may be made of silica gel. The component 342 may be made of plastics. Material hardness of the component 342 may be higher than that of the component 341. Material hardness of the component 342 may be higher than that of the component 343.

The material hardness of the component 342 may be within a range from 65 A to 75 A of a Shore hardness type A. The material hardness of the component 342 may be within a range from 75 A to 85 A of a Shore hardness type A. The material hardness of the component 342 may be within a range from 85 A to 90 A of a Shore hardness type A. The material hardness of the component 341 may be within a range from 20 A to 40 A of a Shore hardness type A. The material hardness of the component 341 may be within a range from 40 A to 60 A of a Shore hardness type A. The material hardness of the component 341 may be within a range from 60 A to 75 A of a Shore hardness type A. The material hardness of the component 343 may be within a range from 20 A to 40 A of a Shore hardness type A. The material hardness of the component 343 may be within a range from 40 A to 60 A of a Shore hardness type A. The material hardness of the component 343 may be within a range from 60 A to 75 A of a Shore hardness type A.

The component 341, the component 342, and the component 343 of the top cap 34 may be combined together by later assembly. Therefore, assembly misalignment and a part tolerance problem may occur among the component 341, the component 342, and the component 343, further leading to a leakage risk (for example, tobacco tar leakage). A bonding force between the component 341 and the component 342 tends to be 0 N (that is, 0 Newton). A bonding force between the component 343 and the component 342 tends to be 0 N. For example, the mutually combined component 341 and the component 342 may be easily separated. The mutually combined component 342 and the component 343 may be easily separated.

When the component 341 is engaged with the component 342, the component 341 surrounds a portion of the component 342. When the component 342 is engaged with the component 343, a portion of the component 342 surrounds the component 343.

When the top cap 34 is engaged with the housing 33, an inner surface of the housing 33 surrounds the component 341. When the top cap 34 is engaged with the heating component 35, the component 343 surrounds the heating component 35.

In some embodiments, an upper surface of the heating component 35 includes a groove. In some embodiments, the lower surface of the heating component 35 has two pins, each of the two pins of the heating component 35 being coupled with a corresponding ejector pin 38. The ejector pin 38 may be coupled with the PCB module 39.

Figure 14A:
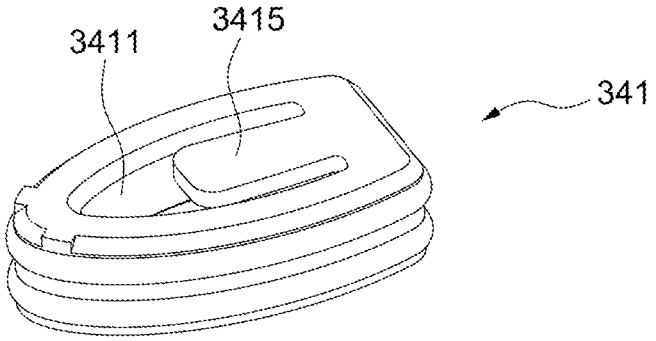
FIG. 14A is a three-dimensional schematic diagram of a top cap component according to some embodiments of this application.
Figure 14B:
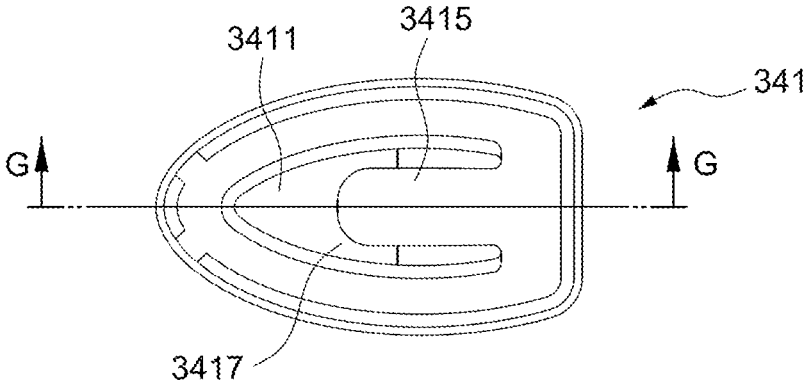
FIG. 14B is a schematic top view of a top cap component according to some embodiments of this application.
Figure 14C:
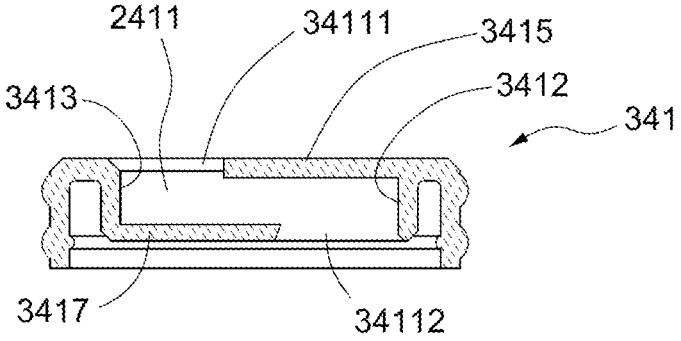
FIG. 14C is a schematic diagram of a cross-sectional structure of a top cap component according to some embodiments of this application.

FIG. 14A is a three-dimensional schematic diagram of a top cap component 341 according to some embodiments of this application. FIG. 14B is a schematic top view of a top cap component 341 according to some embodiments of this application. FIG. 14C is a schematic diagram of a cross-sectional structure of a top cap component 341 according to some embodiments of this application. As shown in FIG. 14A, FIG. 14B, and FIG. 14C, the component 341 has a through hole 3411 penetrating through a body of the component 341. Referring to FIG. 14C, FIG. 14C is a cross-sectional view of FIG. 14B taken along a line A-A. The through hole 3411 has two opposite inner walls: 3412 and 3413. A baffle 3415 extends substantially horizontally from the inner wall 3412 at an upper edge about of the inner wall 3412. A baffle 3417 extends substantially horizontally from the inner wall 3413 at a lower edge about of the inner wall 3413. It further indicates that the baffle 3415 is disposed substantially horizontally at an opening 34111 of the through hole 3411 and protrudes from the inner wall 3412 while the baffle 3417 is disposed substantially horizontally at an opening 34112 of the through hole 3411 and protrudes from the inner wall 3413. In this case, the baffles 3415 and 3417 are configured to form a circuitous channel like a Z shape in the through hole 3411. A vertical projection of the baffle 3415 at least partially overlaps with the baffle 3417.

Figure 15A:
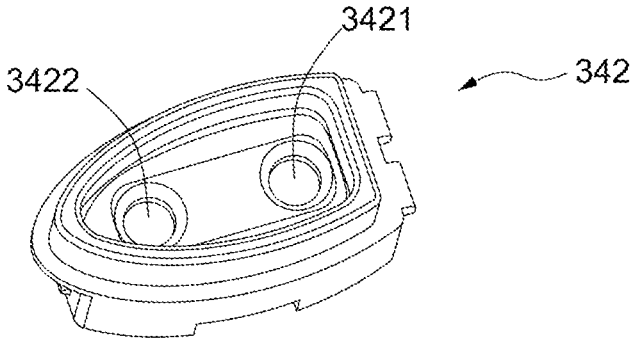
FIG. 15A is a three-dimensional schematic diagram of a top cap component according to some embodiments of this application.
Figure 15B:
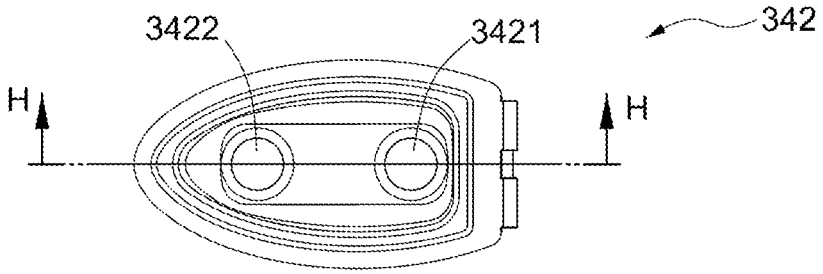
FIG. 15B is a schematic top view of a top cap component according to some embodiments of this application.
Figure 15C:
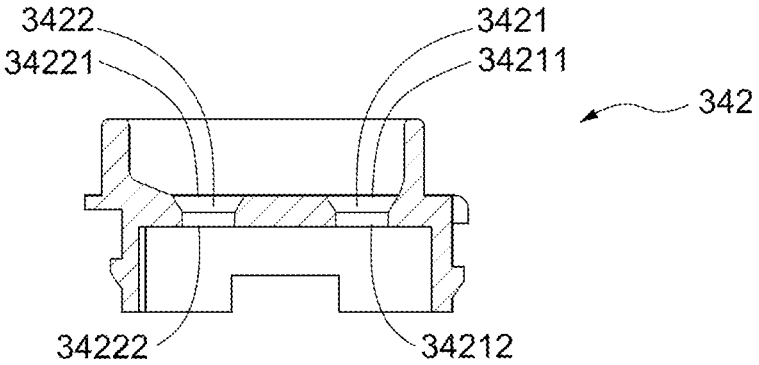
FIG. 15C is a schematic diagram of a cross-sectional structure of a top cap component according to some embodiments of this application.

FIG. 15A is a three-dimensional schematic diagram of a top cap component 342 according to some embodiments of this application. FIG. 15B is a schematic top view of a top cap component 342 according to some embodiments of this application. FIG. 15C is a schematic diagram of a cross-sectional structure of a top cap component 342 according to some embodiments of this application. As shown in FIG. 15A, FIG. 15B, and FIG. 15C, the component 342 has two through holes: 3421 and 3422 each penetrating through a body of the component 342. Referring to FIG. 15C, FIG. 15C is a cross-sectional view of FIG. 15B taken along a line B-B. The through hole 3421 has an upper opening 34211 and a lower opening 34212. The through hole 3422 has an upper opening 34221 and a lower opening 34222.

Figure 16:
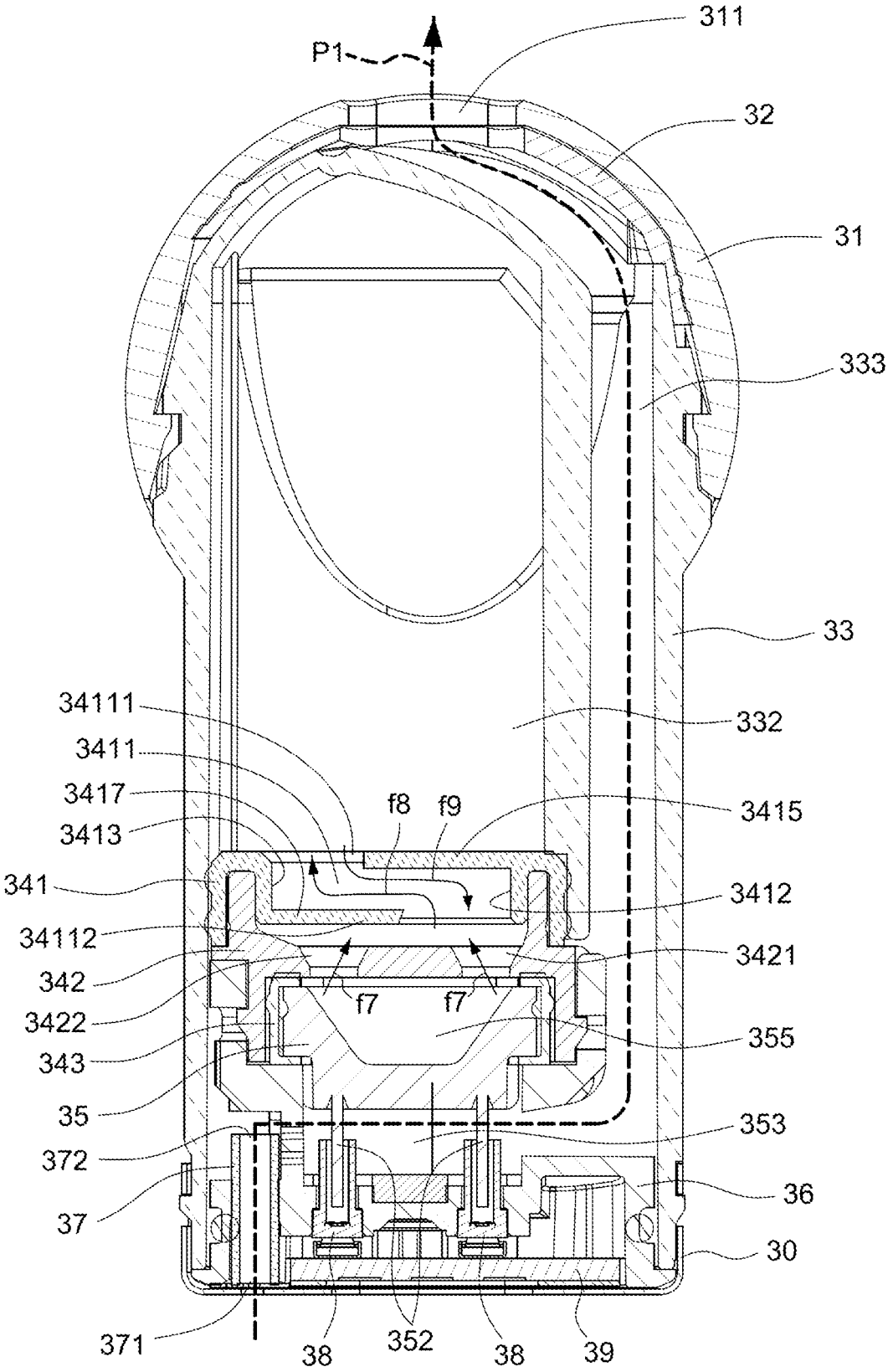
FIG. 16 is a schematic diagram of a cross-sectional structure of a cartridge according to some embodiments of this application.

FIG. 16 is a schematic diagram of a cross-sectional structure of a cartridge 3 according to some embodiments of this application. A housing 33 includes a storage chamber 332. The storage chamber 332 is configured to store a to-be-vaporized fluid substance, such as tobacco tar. A top cap 34 (including a component 341, a component 342 and a component 343) is engaged with the housing 33. In some embodiments, the housing 33 and the top cap 34 define the storage chamber 332. When the top cap 34 is engaged with the housing 33, an inner surface of the housing 33 surrounds the component 341 of the top cap 34. In some embodiments, the housing 33 defines the storage chamber 332. When the top cap 34 is engaged with the housing 33, an inner surface of the storage chamber 332 surrounds the component 341 of the top cap 34. The top cap 34 (including the component 341, the component 342 and the component 343) is engaged with a heating component 35. When the top cap 34 is engaged with the heating component 35, the component 343 of the top cap 34 surrounds the heating component 35.

The component 341 of the top cap 34 has a through hole 3411, while the component 342 has through holes 3421 and 3422. An upper surface of the heating component 35 has a groove. The component 342 and the upper surface of the heating component 35 define a cavity 355.

The storage chamber 332 is in fluid communication with the through hole 3411. The through hole 3411 is in fluid communication with a through hole 3421 and a through hole 3422. The through hole 3411 is in fluid communication with a cavity 355 through the through holes 3421 and 3422. Therefore, the storage chamber 332, the through hole 3411, and the through holes 3421 and 3422 are in fluid communication with the cavity 355. A ratio of the cross-sectional area of the through hole 3421 or 3422 to the cross-sectional area of the storage chamber 332 is substantially from 1:15 to 1:20. Further, a cross-sectional diameter of the through hole 3421 or 3422 is about 1.7 mm.

The heating component 35 includes two pins 352. The pins 352 are coupled with an ejector pin 38. A tube 37 extends from a bottom cap 30 toward the heating component 35. The tube 37 includes two ends. The two ends of the tube 37 each have an opening 371 and an opening 372. The tube 37 extends and partially penetrates through a heating base 36. A hole 361 (as shown in FIG. 13A) of the heating base 36 accommodates the tube 37. The opening 371 of the tube 37 defines an opening on a bottom surface of the heating base 36. The opening 371 of the tube 37 is exposed on the bottom surface of the heating base 36. The heating base 36 includes the opening 371 of the tube 37. A through hole 301 of the bottom cap 30 exposes the opening 371. The opening 371 and the opening 372 of the tube 37 are in fluid communication with the outside.

A dashed arrow in FIG. 16 shows an outlet passage P3 of a cartridge 3. Outside fluid (such as air) flows in from the opening 371 of the tube 37, passes through the tube 37, and flows out from the opening 372 of the tube 37. The air flowing out from the opening 372 of the tube 37 passes through a plurality of holes 363 (as shown in FIG. 13B) of the heating base 36 and flows to a vaporization chamber 353. The vaporization chamber 353 is defined by a lower portion of the heating component 35, the pins 352, and the ejector pin 38. The lower portion of the heating component 35 is exposed in the vaporization chamber 353. Aerial fog generated by heating of the heating component 35 is mixed with air, and the aerial fog mixed with air flows through a passage 333 of the housing 33 to a hole 331 (as shown in FIG. 13A) of the housing 33 and a hole 321 (as shown in FIG. 13A) of a cap 32, and then flows to a hole 311 of a mouthpiece 31 to be sucked by a user.

When the cartridge 3 is used, tobacco tar stored in the storage chamber 332 may first flows into the cavity 355 through the through hole 3411 of the component 241 and the through hole 3421 or 3422 of the component 342. Subsequently, the heating component 35 may start heating the tobacco tar flowing into the cavity 355. When the tobacco tar in the cavity 355 is heated, aerial fog is generated. A portion of the aerial fog enters the passage 333 of the housing 33 along with air entering from the outside to further enter the hole 321 of the cap 32 and the hole 311 of the mouthpiece 31, so that the portion of the aerial fog is sucked by the user. However, if a flow rate at which the tobacco tar flows from the storage chamber 332 to the cavity 355 is too fast, an excessive amount of tobacco tar flows into the cavity 355. In this way, it is likely to cause situations such as tar leakage of the cartridge, a burnt smell, or no smoke. Therefore, some embodiments of this application provide the through hole 3411 of the component 341 and the through holes 3421 and 3422 of the component 342. The through hole 3411 of the component 341 and the through holes 3421 and 3422 of the component 342 are configured to suppress a flow rate at which the tobacco tar flows from the storage chamber 332 to the cavity 355, to prevent the excessive amount of tobacco tar from flowing into the cavity 355. Therefore, the above technical problems can be resolved.

As described above, when the heating component 35 may start heating the tobacco tar flowing into the cavity 355, a portion of smoke produced by the tobacco tar enters the passage 333 of the housing 33 along with air entering from the outside, while another portion of the smoke becomes a bubble that flows to the through hole 3411 of the component 341 through the through holes 3421 and 3422 of the component 342 (see an arrow f7). When the bubble formed by the portion of the smoke flows into the through hole 3411, baffles 3415 and 3417 of the through hole 3411 are configured to form a Z-shaped circuitous path in the through hole 3411. Due to the Z-shaped circuitous path formed in the through hole 3411, the bubble needs to travel a longer path to pass through the through hole 3411 and further enter the storage chamber 332 (see an arrow f8). In this way, the bubble spends more time staying in the through hole 3411. Similarly, the tobacco tar flowing from the storage chamber 332 into the cavity also needs to pass through the Z-shaped circuitous path of the through hole 3411. In this way, the tobacco tar also travels a longer path to pass through the through hole 3411, further flows to the through holes 3421 and 3422 of the component 342 (see an arrow f9), and further flows into the cavity 355. Therefore, a flow rate at which the tobacco tar flows from the storage chamber 332 to the cavity 355 through the components 341 and 342 is reduced. Further, the bubble spends more time staying in the through hole 3411, and the bubble staying in the through hole 3411 partially prevents the tobacco tar from passing through the through hole 3411, which further reduces the flow rate at which the tobacco tar passes through the through hole 3411. Based on the foregoing, the baffles 3415 and 3417 of the through hole 3411 can effectively reduce a flow rate at which the tobacco tar flows from the storage chamber 332 to the cavity 355 through the components 341 and 342.

In the foregoing way, the flow rate at which the tobacco tar in the storage chamber 332 flows to the cavity 355 can be effectively suppressed to prevent the excessive amount of tobacco tar from flowing into the cavity 355.

Figure 17A:
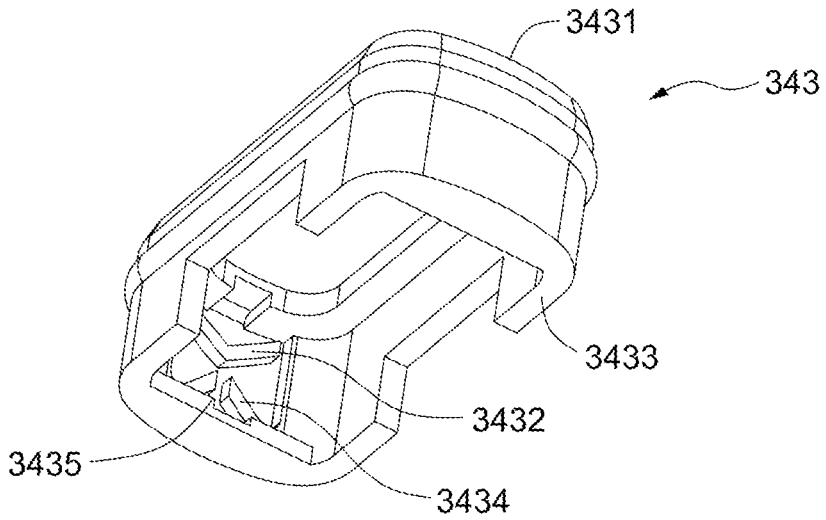
FIG. 17A is a three-dimensional view of a top cap component according to some embodiments of this application.
Figure 17B:
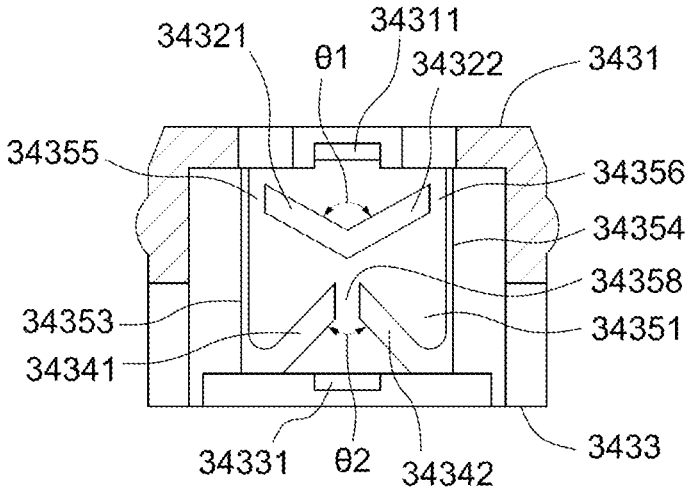
FIG. 17B is a schematic diagram of a side wall of a top cap component according to some embodiments of this application.
Figure 17C:
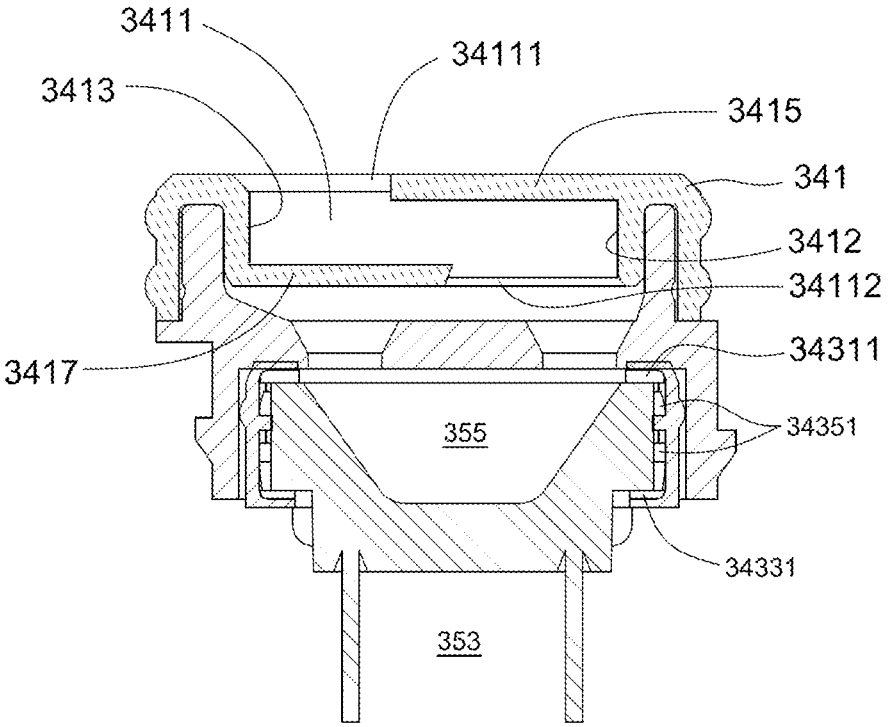
FIG. 17C is a partial cross-sectional diagram of a cartridge according to some embodiments of this application.
Figure 17D:
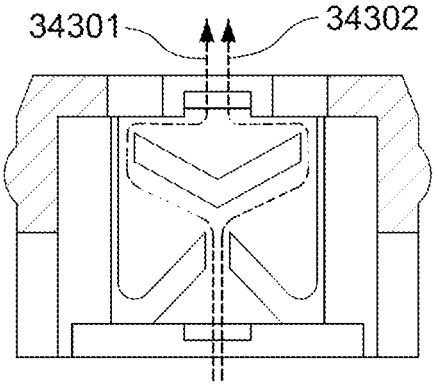
FIG. 17D is a schematic diagram of a side wall of a top cap according to some embodiments of this application.

FIG. 17A is a three-dimensional view of a top cap component according to some embodiments of this application. FIG. 17B is a schematic diagram of a side wall of a top cap component according to some embodiments of this application. FIG. 17C is a partial cross-sectional diagram of a cartridge according to some embodiments of this application. FIG. 17D is a schematic diagram of a side wall of a top cap component according to some embodiments of this application.

As described above, the component 343 may be a sealing element. As shown in FIG. 17A, FIG. 17B, and FIG. 17C, the component 343 has a top 3431, a bottom 3433, and a side wall 3435 extending between the top 3431 and the bottom 3433. The side wall 3435 has a groove 34351. The top 3431 of the component 343 has a groove 34311. The bottom 3433 of the component 343 has a groove 34331.

The side wall 3435 includes a partition 3432. The partition 3432 includes a segment 34321 and a segment 34322, one end of the segment 34321 being directly connected to one end of the segment 34322. The other end of the segment 34321 and one side 34353 of the groove 34351 form a gap 34355. The other end of the segment 34322 and the other side 34354 of the groove 34351 form a gap 34356. In some embodiments, an angle between the segment 34321 and the segment 34322 is between 90 degrees to 180 degrees. In some embodiments, an angle between the segment 34321 and the segment 34322 is between 90 degrees to 120 degrees. In some embodiments, an angle between the segment 33421 and the segment 34322 is between 120 degrees to 150 degrees. In some embodiments, an angle between the segment 34321 and the segment 34322 is between 150 degrees to 180 degrees. In some embodiments, the segment 34321 and the segment 34322 form a V shape with an opening upward (for example, a vertically upward direction shown in FIG. 17B).

The side wall 3435 of the component 343 further includes a partition 3434. The second partition 3434 includes a segment 34341 and a segment 34342. A gap 34358 is formed between the segment 34341 and the segment 34342. There is an angle between the segment 34341 and the segment 34342. In some embodiments, the angle between the segment 34341 and the segment 34342 may be different from the angle between the segment 34321 and the segment 34322. In some embodiments, the angle between the segment 34341 and the segment 34342 may be the same as the angle between the segment 34321 and the segment 34322. In some embodiments, the segment 34341 and the segment 34342 form an inverted V shape with an opening downward (for example, a vertically downward direction shown in FIG. 17B).

When the component 343 covers the heating component 35, at least one cavity (or referred to as a ventilation channel) is defined among the partition 3432, the partition 3434, the groove 34351, and the heating component 35. In particular, a ventilation channel 34301 (as shown in FIG. 17D) may be defined among the groove 34331, the gap 34358, the gap 34355, and the groove 34311. A vaporization chamber 353 may be in fluid communication with a storage chamber (the storage chamber 332 shown in FIG. 16) through the ventilation channel 34301. A ventilation channel 34302 (as shown in FIG. 17D) may be defined among the groove 34331, the gap 34358, the gap 34356, and the groove 34311. A vaporization chamber 353 may be in fluid communication with a storage chamber (the storage chamber 332 shown in FIG. 16) through the ventilation channel 34302.

As a user continues to use a vaporization device, a vaporizable material in the storage chamber 332 is continuously consumed and reduced so that a pressure in the storage chamber 332 is gradually reduced. If the pressure in the storage chamber 332 is reduced, a negative pressure may be generated. If the pressure in the storage chamber 332 is reduced, the vaporizable material (for example, tobacco tar) may be unlikely to flow into a cavity 355 of the heating component 35 through passages 3421 and 3422. When the cavity 355 does not completely absorb the vaporizable material, the high-temperature heating component 35 may burn drily and generate a scorched smell.

The foregoing situations can be improved by disposing a ventilation channel in the side wall of the component 343. The ventilation channel (a flowing direction shown by arrows in FIG. 17D) formed in the side wall of the component 343 may balance a pressure in the storage chamber 332.

Figure 18A:
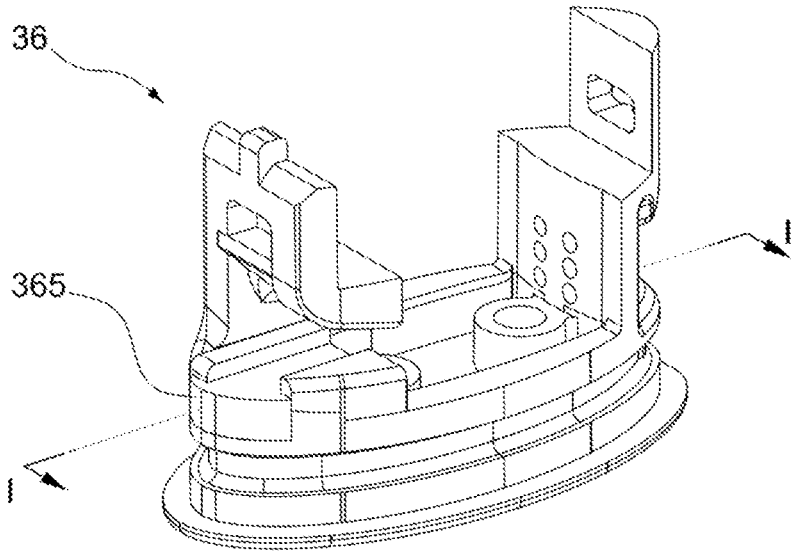
FIG. 18A is a three-dimensional schematic diagram of a heating base according to some embodiments of this application.
Figure 18B:
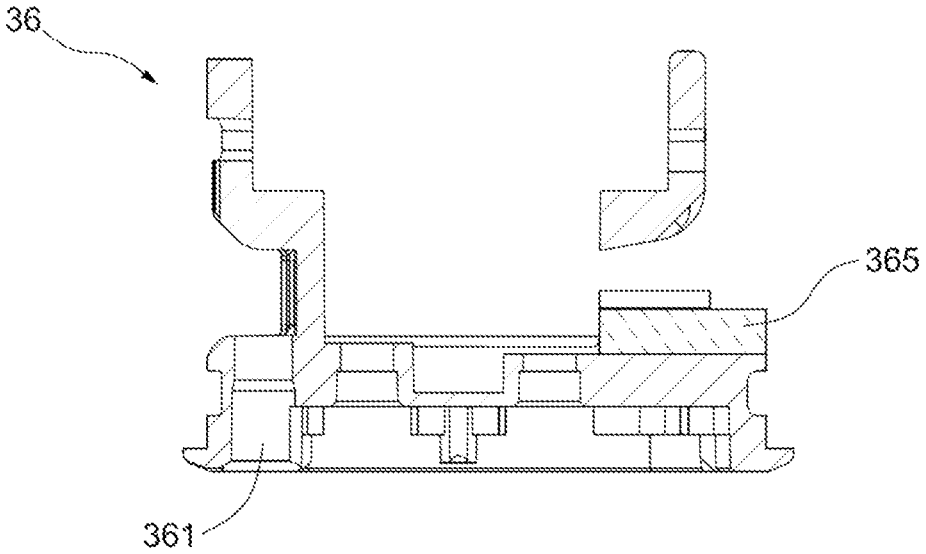
FIG. 18B is a schematic diagram of a cross-sectional structure of a heating base according to some embodiments of this application.

As described above, the cartridge 3 further includes a tar absorbing pad 351 located below the heating component 35. The tar absorbing pad 351 may be configured to absorb tobacco tar that may leak (see FIG. 13A). However, when the user inhales, air passes through the passage P3 as shown in FIG. 16. When the air passes through the vaporization chamber 353, vaporized tobacco tar is mixed with cold air, which may condense the vaporized tobacco tar, and tobacco tar incompletely absorbed by the tar absorbing pad 351 may spill out of the cartridge 3. In order to prevent the tobacco tar incompletely absorbed by the tar absorbing pad 351 from spilling out, the heating base 36 in some embodiments of this application further includes a tar absorbing pad 365 (see FIG. 18A). The tar absorbing pad 365 is disposed at an opposite end of one end at which an opposite hole 361 is located (see FIG. 18B). A material of the tar absorbing pad 365 is macromolecule cotton, but may be selected according to an actual situation and is not limited thereto.

References throughout the specification to "some embodiments," "partial embodiments," "one embodiment," "another example," "example," "specific example" or "partial examples" mean that at least one embodiment or example of the application comprises specific features, structures, or characteristics described in the embodiments or examples. Thus, the descriptions appear throughout the specification, such as "in some embodiments," "in an embodiment," "in one embodiment," "in another example," "in an example," "in a particular example" or "for example," are not necessarily the same embodiment or example in the application.

As used herein, space-related terms such as "under", "below", "lower portion", "above", "upper portion", "lower portion", "left side", "right side", and the like may be used herein to simply describe a relationship between one component or feature and another component or feature as shown in the figures. In addition to orientation shown in the figures, space-related terms are intended to encompass different orientations of the device in use or operation. An apparatus may be oriented in other ways (rotated 90 degrees or at other orientations), and the space-related descriptors used herein may also be used for explanation accordingly. It should be understood that when a component is "connected" or "coupled" to another component, the component may be directly connected to or coupled to another component, or an intermediate component may exist.

As used herein, the terms "approximately", "substantially", "basically", and "about" are used to describe and explain small variations. When used in combination with an event or a situation, the terms may refer to an example in which an event or a situation occurs accurately and an example in which the event or situation occurs approximately. As used herein with respect to a given value or range, the term "about" generally means in the range of ±10%, ±5%, ±1%, or ±0.5% of the given value or range. The range may be indicated herein as from one endpoint to another endpoint or between two endpoints. Unless otherwise specified, all ranges disclosed herein include endpoints. The term "substantially coplanar" may refer to two surfaces within a few micrometers (μm) positioned along the same plane, for example, within 10 μm, within 5 μm, within 1 μm, or within 0.5 μm located along the same plane. When reference is made to "substantially" the same numerical value or characteristic, the term may refer to a value within ±10%, ±5%, ±1%, or ±0.5% of the average of the values.

As used herein, the terms "approximately", "substantially", "basically", and "about" are used to describe and explain small variations. When used in combination with an event or a situation, the terms may refer to an example in which an event or a situation occurs accurately and an example in which the event or situation occurs approximately. For example, when being used in combination with a value, the term may refer to a variation range of less than or equal to ±10% of the value, for example, less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, if a difference between two values is less than or equal to ±10% of an average value of the value (for example, less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%), it could be considered that the two values are "substantially" the same. For example, being "substantially" parallel may refer to an angular variation range of less than or equal to ±10° with respect to 0°, for example, less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°. For example, being "substantially" perpendicular may refer to an angular variation range of less than or equal to ±10° with respect to 90°, for example, less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°.

As used herein, the singular terms "a/an" and "the" may include plural referents unless the context clearly dictates otherwise. In the description of some embodiments, assemblies provided "on" or "above" another assembly may encompass a case in which a former assembly is directly on a latter assembly (for example, in physical contact with the latter assembly), and a case in which one or more intermediate assemblies are located between the former assembly and the latter assembly.

Unless otherwise specified, spatial descriptions such as "above", "below", "upper", "left", "right", "lower", "top", "bottom", "vertical", "horizontal", "side", "higher", "lower", "upper portion", "on", "under", and "downward" are indicated relative to the orientations shown in the figures. It should be understood that the space descriptions used herein are merely for illustrative purposes, and actual implementations of the structures described herein may be spatially arranged in any orientation or manner, provided that the advantages of embodiments of the present application are not deviated due to such arrangement.

While the present disclosure has been described and illustrated with reference to specific embodiments thereof, these descriptions and illustrations do not limit the present disclosure. It should be understood by those skilled in the art that various changes may be made and equivalents may be substituted without departing from the true spirit and scope of the present disclosure as defined by the appended claims. The illustrations may not be necessarily drawn to scale. There may be distinctions between the artistic renditions in the present disclosure and the actual apparatus due to manufacturing processes and tolerances. There may be other embodiments of the present disclosure which are not specifically illustrated. The specification and drawings are to be regarded as illustrative rather than restrictive. Modifications may be made to adapt a particular situation, material, composition of matter, method, or process to the objective, spirit and scope of the present disclosure. All such modifications are intended to be within the scope of the claims appended hereto. While the methods disclosed herein have been described with reference to particular operations performed in a particular order, it will be understood that these operations may be combined, sub-divided, or re-ordered to form an equivalent method without departing from the teachings of the present disclosure. Therefore, unless otherwise specifically indicated herein, the order and grouping of operations shall not be construed as any limitation on the present application.

Several embodiments of the present disclosure and features of details are briefly described above. The embodiments described in the present disclosure may be easily used as a basis for designing or modifying other processes and structures for realizing the same or similar objectives and/or obtaining the same or similar advantages introduced in the embodiments of the present disclosure. Such equivalent construction does not depart from the spirit and scope of the present disclosure, and various variations, replacements, and modifications can be made without departing from the spirit and scope of the present disclosure.

What is claimed is:

1. A vaporization device comprising:

a housing comprising a storage chamber;

a top cap disposed in the housing and connected to the storage chamber; and a heating assembly disposed in the housing and connected to the top cap, wherein the top cap comprises a first top cap component and a second top cap component that are engaged with each other and in fluid communication with each other, the first top cap component being connected to the storage chamber, and the second top cap component being connected to the heating assembly, wherein the first top cap component comprises a first through hole in fluid communication with the storage chamber, the first through hole comprising a first side wall and a second side wall opposite to the first side wall, wherein the first through hole comprises a first baffle at a location close to the storage chamber, the first baffle extending and protruding from the first side wall; and the first through hole comprises a second baffle at a location close to the second top cap component, the second baffle extending and protruding from the second side wall.

2. The vaporization device according to claim 1, wherein the first baffle substantially extends horizontally from the first side wall, and the second baffle substantially extends horizontally from the second side wall.

3. The vaporization device according to claim 1, wherein the first baffle at least partially overlaps the second baffle from a top view perspective.

4. The vaporization device according to claim 1, wherein the first baffle is spaced from the second baffle from a top view perspective.

5. The vaporization device according to claim 1, wherein the second top cap component comprises a second through hole and a third through hole that are in fluid communication with the heating assembly.

6. The vaporization device according to claim 5, wherein a ratio of the cross-sectional area of the second through hole or the third through hole to the cross-sectional area of the storage chamber is about 1:15 to 1:20.

7. The vaporization device according to claim 5, wherein a cross-sectional diameter of the second through hole or the third through hole is about 1.7 mm.

8. The vaporization device according to claim 1, wherein the top cap further comprises a sealing element engaged with the second top cap component and interconnected with the heating assembly.

9. The vaporization device according to claim 8, wherein the heating assembly comprises a heating component and a heating base for supporting the heating component, and the sealing element is disposed on the heating component.

10. The vaporization device according to claim 9, wherein the sealing element comprises a top, a bottom and a third side wall extending between the top and bottom, the third side wall comprising a first groove, the top comprising a second groove, and the bottom comprising a third groove, a cavity being defined between the first groove and the heating component.

11. The vaporization device according to claim 10, wherein the third side wall of the sealing element comprises a first partition, the first partition comprising a first segment and a second segment, and a first end of the first segment being interconnected with a second end of the second segment.

12. The vaporization device according to claim 11, wherein there is a first angle between the first segment and the second segment, the first angle being between about 90 degrees and 180 degrees.

13. The vaporization device according to claim 11, wherein the first segment comprises a third end opposite to the first end, and the second segment comprises a fourth end opposite to the second end, a first gap being formed between the third end and a first surface of the first groove, and a second gap being formed between the fourth end and a second surface that is of the first groove and that is opposite to the first surface.

14. The vaporization device according to claim 11, wherein the third side wall of the sealing element further comprises a second partition, the second partition comprising a third segment and a fourth segment, a third gap being formed between a fifth end of the third segment and a sixth end of the fourth segment.

15. The vaporization device according to claim 14, wherein there is a first angle between the first segment and the second segment, and there is a second angle between the third segment and the fourth segment, the first angle being different from the second angle.

16. The vaporization device according to claim 14, wherein the third segment extends at an angle from a first side of the first groove toward a second side that is of the first groove and that is opposite to the first side, and the fourth segment extends at an angle from the second side of the first groove toward the first side of the first groove.

17. The vaporization device according to claim 8, wherein the first top cap component, the second top cap component and the sealing element are made of different materials.

18. The vaporization device according to claim 1, wherein the first top cap component is made of silica gel.

19. The vaporization device according to claim 8, wherein the sealing element is made of silica gel.

20. The vaporization device according to claim 9, further comprising a first tar absorbing pad, the first tar absorbing pad being disposed between the heating component and the heating base.

21. The vaporization device according to claim 9, wherein the heating base comprises a first opening, and the heating assembly is connected to the outside through the first opening.

22. The vaporization device according to claim 21, wherein the first opening is disposed adjacent to a first end of the heating base, a second end opposite to the first end of the heating base comprising a second tar absorbing pad.

23. The vaporization device according to claim 20, wherein the first tar absorbing pad is made of macromolecule cotton.

24. The vaporization device according to claim 22, wherein the second tar absorbing pad is made of macromolecule cotton.

25. The vaporization device according to claim 9, further comprising a circuit board electrically connected to the heating component.

* * * * *